United States Patent [19]

Yabuki et al.

[11] Patent Number: 4,832,912

[45] **Date of Patent: * May 23, 1989**

[54] THERMAL AND WEAR RESISTANT TOUGH ALLOY

[75] Inventors: Ritsue Yabuki, Iwatsuki; Junya Ohe, Urawa; Takumi Kawamura, Iwatsuki, all of Japan

[73] Assignee: Mitsubishi Kinzoku Kabushiki Kaisha, Tokyo, Japan

[ * ] Notice: The portion of the term of this patent subsequent to Mar. 1, 2005 has been disclaimed.

[21] Appl. No.: 142,284

[22] Filed: Dec. 29, 1987

Related U.S. Application Data

[63] Continuation of Ser. No. 919,578, Oct. 15, 1986, abandoned, which is a continuation of Ser. No. 726,962, Apr. 29, 1985, abandoned, which is a continuation of Ser. No. 495,334, Apr. 27, 1983, abandoned.

[30] Foreign Application Priority Data

Aug. 27, 1981 [JP] Japan ..... 56-13450

[51] Int. Cl.[4] ..... C22C 30/00

[52] U.S. Cl. ..... 420/586

[58] Field of Search ..... 420/586.1

[56] References Cited

U.S. PATENT DOCUMENTS

| | | | |
|---|---|---|---|
| 4,279,645 | 7/1981 | Brown | 420/586 |
| 4,430,297 | 2/1984 | Crook | 420/584 |
| 4,727,740 | 3/1988 | Yabuki et al. | 420/584 |

FOREIGN PATENT DOCUMENTS

| | | | |
|---|---|---|---|
| 54-128921 | 3/1978 | Japan | 420/586 |
| 0024214 | 2/1979 | Japan | 420/586 |
| 54-24214 | 2/1979 | Japan | 420/586 |
| 0128921 | 10/1979 | Japan | 420/586 |
| 0169755 | 12/1981 | Japan | 420/584 |
| 0023050 | 2/1982 | Japan | 420/586 |
| 0039159 | 3/1982 | Japan | 420/584 |

OTHER PUBLICATIONS

Verlag Stahlschlüssel Wegst KG., Key to Steels, W. Germany, 10 Edition, 1974.

*Primary Examiner*—Deborah Yee

*Attorney, Agent, or Firm*—Cushman, Darby & Cushman

[57] ABSTRACT

This invention relates to the thermal and wear resistant, tough alloy at elevated temperatures. The alloy consists essentially of carbon, chromium, nickel, titanium, aluminium, tungsten, molybdenum, silicon, manganese, cobalt and balance iron, further the alloy includes optionally at least one selected from the group consisting of nitrogen, niobium and tantalum, further the alloy includes optionally at least one selected from the group consisting of nitrogen, niobium and tantalum, further the alloy includes optionally at least one selected from the group consisting of boron and zirconium. The alloy according to this invention are widely utilized to serve as the alloy for build-up weld and for guide shoe used in the hot rolling apparatus for fabricating seamless steel pipe.

58 Claims, No Drawings

THERMAL AND WEAR RESISTANT TOUGH ALLOY

This is a continuation of application Ser. No. 919,578, filed Oct. 15, 1986, which is a continuation of Ser. No. 726,962, filed Apr. 29, 1985, which is a continuation of Ser. No. 495,334, filed Apr. 27, 1983, all of which have been abandoned upon the filing hereof.

FIELD OF THE INVENTION

This invention relates to the thermal and wear resistant, tough alloy at elevated temperatures.

The alloy consists essentially of carbon, chromium, nickel, titanium, aluminium, tungsten, molybdenum, silicon, manganese, cobalt and iron, and the alloy further include optionally nitrogen, and at least one selected from the group consisting of niobium, tantalum and the alloy further include optionally at least one selected from the group consisting of boron, zirconium. The alloys of this invention relate to alloys for many application that can be used for providing the build-up welding and for providing the guide shoe for use a hot rolling apparatus for fabricating seamless steel pipes.

BACKGROUND OF THE INVENTION

Generally, a hot rolling apparatus for fabricating seamless steel pipes comprises a pair of upper and lower tapered rolls of a barrel shape disposed in intersecting relation to each other opposed guide shoes disposed on opposite sides of center axes of the tapered barrel rolls and spearhead shaped plug disposed intermediate the tapered barrel rolls in front thereof. A round billet heated at temperature of 1150° to 1250° C. is supplied to the hot rolling apparatus of the tapered roll type. The round billet in hot pierced at its center by the plug while it is being rotated by the tapered barrel rolls. Thereafter, the pierced billet is rolled repeatedly and formed into a seamless steel pipe. In this case, during the fabrication of the pipe, it assumes an elliptical shape due to compressive force and projective force exerted by the tapered barrel rolls. The guide shoes are arranged 90 degrees circumferentially of each roll in opposed relation to each other so as to control the outer shape and the thickness of the pipe. Therefore, the guide shoes are in contact with the steel pipe heated at elevated temperatures, so that the surface of the guide shoes are held in sliding contact with the rotatingly advancing steel pipes.

As a result, the guide shoes are repeatedly subjected to a rapid heating at elevated temperatures and a rapid cooling by cooling water Further, the guide shoes undergo rolling sliding friction under greater stress load.

The guide shoes conventionally used under such serve conditions are made of a material such as an alloy consisting of 26% by weight of chromium—3% by weight of nickel—the balance iron alloy, 26% by weight of chromium—2% by weight of nickel—the balance iron alloy having thermal and wear resistant steel alloy at elevated temperatures, 1% by weight of carbon—5% by weight of copper—the balance iron alloy and 1% by weight of carbon—15% by weight of chromium—5% by weight of molybdenum—the balance nickel alloy. Some of these alloys affect a yield to fabricate a seamless steel pipe because of insufficient corrosion resistance at elevated temperatures. Scales or steel pieces formed at the surface of the steel pipe heated at elevated temperatures are stuck to the surface of the guide shoes by the heat involved. The stuck scales or steel pieces of the guide shoes give rise to damage to the surface thereby affecting the yield rate of the fabrication of the steel pipe. Also some of conventional alloys cannot withstand a thermal shock due to repeated of local heating and water cooling. As a result, cracks are formed on the surface of the guide shoe, so that subjected to damage.

Further some of these conventional alloys are not sufficient in wear resistance. Guide shoe made of such alloy has a shorter service life.

After an extensive study to provide an alloy which are sufficient in thermal resistance, wear resistance, toughness and hardness for use as guide shoes for a hot rolling apparatus of the tapered roller type for fabricating seamless steel pipe, this invention is achieved.

DISCLOSURE OF THE INVENTION

An object of this invention is to provided alloys having thermal shockproof, thermal and wear resistance, and corrosion resistance at elevated temperatures.

Another object of this invention is to provided such alloys for use as guide shoes for hot rolling apparatus of the tapered roller type for fabricating seamless steel pipe.

The alloy of this invention comprises 0.55 to 1.9 percent by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, the balance iron and incidental impurity, the alloy including optionally 0.1 to 3% by weight of silicon, 0.1 to 2% by weight of manganese, 1 to 8% by weight of cobalt, the alloy including optionally at least one selected from the group consisting of 0.005 to 0.2% by weight of nitrogen, 0.01 to 1.5% by weight of niobium and tantalum and the alloy including optionally at least one selected from the group consisting of 0.001 to 0.2% by weight of boron and zirconium.

The invention will now be more specifically described.

A thermal and wear resistant, tough alloy according to a first embodiment of this invention consists essentially of 0.65 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, the balance iron and incidental impurities, the alloy further including optionally 0.1 to 3% by weight of silicon, 0.1 to 2% by weight of manganese, the alloy further including optionally at least one selected from the group consisting of 0.005 to 0.2% by weight of nitrogen, 0.01 to 1.5% by weight of niobium and tantalum, the alloy further including optionally at least one selected from the group consisting of 0.001 to 0.2% by weight of boron and zirconium.

Furthermore, a thermal and wear resistant, tough alloy according to a second embodiment of this invention consists essentially of 0.65 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, 1 to 8% by weight of cobalt, the balance iron and incidental impurities, the alloy further including optionally 0.1 to 3% by weight of silicon, 0.1 to 2% by weight of manganese, the alloy further including optionally at least one selected from the group consisting of 0.005 to 0.2% by weight of nitrogen, 0.01 to 1.5% by weight of niobium and tantalum, and the alloy further including optionally at least one selected from the group consisting of 0.001 to 0.2% by weight of boron and zirconium.

Furthermore a thermal and wear resistant, tough alloy according to third embodiment of this invention consists essentially of 0.7 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, 0.1 to 3% by weight of silicon, 0.1 to 2% by weight of manganese, the balance iron and incidental impurities, the alloy further including optionally at least one selected from the group consisting of 0.005 to 0.2% by weight of nitrogen, 0.01 to 1.5% by weight of niobium and tantalum, the alloy further including optionally at least one selected from the group consisting of 0.001 to 0.2% by weight of boron and zirconium. Furthermore, a thermal and wear resistant, tough alloy according to a fourth embodiment of this invention consists essentially of 0.65 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, 0.1 to 3% by weight of silicon, 0.1 to 2% by weight of manganese, 1 to 8% by weight of cobalt, the balance iron and incidental impurities, the alloy further including optionally at least one selected from the group consisting of 0.005 to 0.2% by weight of nitrogen, 0.01 to 1.5% by weight of niobium and tantalum, the alloy further including optionally at least one selected from the group consisting of 0.001 to 0.2% by weight of boron and zirconium.

THE PREFERRED EMBODIMENTS OF THE INVENTION

The effect of the components of the thermal and wear resistant, tough alloy at elevated temperatures according to the invention and the reason why the component have specified contents will now be described.

Carbon: Carbon is dissolved into an alloy matrix at elevated temperatures. Carbon also reacts with chromium, tungsten, molybdenum, titanium, niobium, tantalum and so on to form carbides such as $M_7C_3$, MC and $M_{23}C_6$ so that the resultant alloy is improved in the strength and the hardness. Therefore, carbon content serves to impact an excellent wear resistance to the alloy and also imparts the weldability and the castability to the alloy. When the carbon content is below 0.65% by weight, the alloy fails to have the abovementioned properties. On the other hand, when the carbon content exceeds 1.9% by weight, the resultant alloy has an increased amount of deposition of carbides, and also a particle size of the carbides becomes larger to lower the toughness of the alloy so that the alloy can not withstand a thermal shock due to the rapid heating and cooling. Therefore, it is determined that the carbon content should be 0.7 to 1.9% by weight.

Chromium: Chromium is dissolved into an alloy matrix in parts and the remainder reacts with carbon to form carbides. The resultant alloy is improved in the wear resistance and the hardness at elevated temperatures. Chromium serves to impart the corrosion resistance at elevated temperatures. When chromium content is below 28% by weight, the alloy fails to have the abovementioned properties. When chromium content exceeds 39% by weight, the alloy has a decreased amount of the thermal shock resistance. Therefore, it is determined that chromium content should be 28 to 39% by weight.

Nickel: Nickel is dissolved into an alloy matrix to stabilize austenite matrix and enhance the thermal shock resistance and the toughness. On the other hand, nickel reacts with aluminium and titanium to form an intermetallic compound such as $\{Ni_3(Al, Ti)\}$, furthermore the resultant alloy is improved in the strength and the wear resistance at elevated temperatures similar to chromium. When the nickel content is below 25% by weight, the alloy fails to have the abovementioned properties. When the nickel content exceeds 49% by weight, the alloy fails to have more improved properties. Therefore, it is determined that nickel content should be 25 to 49% by weight in view of economical use.

Titanium: Titanium not only suppresses a growth of a crystal grain in the alloy matrix but atomize preferably the crystal grain. Titanium reacts with carbon and nitrogen to form MC type carbide and nitride, further reacts with nickel and aluminium to form the intermetallic compound such as abovementioned $\{Ni_3(Al, Ti)\}$. The resultant alloy is improved in the strength and the wear resistance at elevated temperatures. When the titanium content is below 0.01% by weight, the alloy fails to have the abovementioned properties. When the titanium content exceeds 4.5% by weight, the resultant alloy is deteriorated in the toughness of the alloy due to accelerate the formation of carbide at elevated temperatures and further deteriorated the corrosion resistance at elevated temperature due to proceed remarkably the formation oxide at elevated temperatures. Therefore, it is determined that the titanium content should be 0.01 to 3.5% by weight.

Aluminium: The alloy is improved by the addition of aluminium the oxidation resistance and the corrosion resistance at elevated temperatures in the coexistence of chromium. As abovementioned, aluminium reacts with nickel and titanium to from the intermetallic compound such as $\{Ni_3(Al, Ti)\}$ and further reacts with nitrogen to form nitride. The resultant is improved in the strength and the wear resistance at elevated temperatures and improved in the thermal shock resistance and the toughness.

When the aluminium content is below 0.01% by weight, the alloy fails to have the abovementioned properties. When the aluminium content exceeds 4.5% by weight, the resultant alloy shows the decrease of the fluidity and the castability in the melt, as a result, the resultant alloy not only becomes difficulty the production in the casting but cannot make use of the production in practice because of the deterioration of the toughness and the weldability. Therefore, it is determined that the aluminium content should be 0.01 to 4.5% by weight, furthermore preferably, 0.01 to 3.5% by weight.

Tungsten: Tungsten is dissolved into an alloy matrix. Tungsten also reacts with carbon to form a carbide. The resultant alloy is improved in the hardness and the wear resistance at elevated temperatures. When tungsten content is below 0.1% by weight, the resultant alloy fails to have the abovementioned properties. When the tungsten content exceeds 8% by weight, the resultant alloy is improved the wear resistance, but also is deteriorated the toughness and the thermal shock. Therefore, it is determined that the tungsten content should be 0.1 to 8% by weight, furthermore preferably 0.5 to 8% by weight.

Molybdenum: The alloy is improved by the addition of molybdenum the wear resistance at elevated temperatures similar to tungsten component.

When molybdenum content is below 0.1% by weight, the resultant alloy fails to have the abovementioned properties. When the molybdenum content exceeds 9% by weight, the resultant alloy is deteriorated the toughness and the thermal shock resistance. Therefore, it is determined that the molybdenum content should be 0.1 to 9% by weight, furthermore preferably 0.5 to 9% by weight.

Silicon: The alloy is improved by the addition of silicon the thermal resistance, the deoxidation effect and the fluidity of the melt similar to chromium. The resistant alloy is improved in the castability and the strength at elevated temperatures.

When the silicon content is below 0.1% by weight, the resultant alloy fails to have the abovementioned properties. When the silicon content exceeds 3% by weight, the resultant alloy is deteriorated the toughness and the weldability in the relation of chromium component. Therefore, it is determined that the silicon content should be 0.1 to 3% by weight. When silicon is used as the deoxidation agent, however, silicon includes below 0.1% by weight of th incidental impurities. It is suitable in this case that the silicon included with the incidental impurities is added over 0.1% by weight.

Manganese: Manganese is dissolved into the alloy matrix to stabilize the austenite matrix. The resultant alloy is improved in the thermal shock resistance and the wear resistance at elevated temperatures and the effect of the deoxidation.

When the manganese content is below 0.1% weight, the resultant alloy fails to have the abovementioned properties. When the manganese content exceeds 2% by weight, the resultant alloy is deteriorated the corrosion resistance at elevated temperatures. Therefore, it is determined that the manganese content should be 0.1 to 2% by weight. Manganese component similar to silicon component includes below 0.1% by weight of the incidental impurities. It is suitable in this case that the manganese included with the incidental impurities is added over 0.1% by weight.

Cobalt: Cobalt is dissolved into the austenite matrix to improve the strength at elevated temperatures. The resultant alloy is improved in the wear resistance and the thermal shock resistance at elevated temperatures. When the cobalt content is below 1% by weight, the resultant alloy fails to have the abovementioned properties. When the cobalt content exceeds 8% by weight, the resultant alloy does not show more effective improvement but rather than shows the decrease of the abovementioned properties. Therefore, it is determined that the cobalt content should be 1 to 8% by weight.

Nitrogen: Nitrogen is dissolved into the austenite matrix to stabilize the alloy. Nitrogen also reacts with a metal component to form the nitride of the metal. The resultant alloy is improved in the strength at elevated temperatures. When the resultant alloy is required to have the strength at elevated temperatures, the nitrogen component is included optionally in the alloy. When the nitrogen content is below 0.005% by weight, the resultant alloy does not improve in more effective strength at elevated temperatures. When the nitrogen content exceeds 0.2% by weight, the resultant alloy not only has an increased amount of nitride but has a gross particle of the nitride. The resultant alloy is a brittle alloy and is deteriorated in the thermal shock resistance. Therefore, it is determined that the nitrogen content should be 0.005 to 0.2% by weight.

Niobium and tantalum: The alloy is suppressed by the addition of these component specially to the growth of the crystal in the alloy matrix. These component also react with carbon and nitrogen to form the MC type carbide and the nitride. The resultant alloy is improved in the strength and the wear resistance at elevated temperatures, also improved more homogenized action. When the resultant alloy is required to have the abovementioned properties, niobium and tantalum is added optionally into the alloy. When niobium and tantalum content are below 0.01% by weight, the resultant alloy fails to have the abovementioned properties. When niobium and tantalum content exceed 1.5% by weight, the resistant alloy is deteriorated in the corrosion resistance due to increase the growth of the oxide at elevated temperatures and furthermore deteriorated the toughness and the wear resistance due to increase extraordinarily the formation of the carbide. Therefore, it is determined that niobium and tantalum content should be 0.01 to 1.5% by weight.

Boron and zirconium: The alloy is improved by the addition of these component the homogenized action and the strength, the wear resistance, the thermal shock resistance and the corrosion resistant at elevated temperatures. When boron and zirconium contents are below 0.001% by weight, the resultant alloy fail to have the abovementioned properties. When boron and zirconium contents exceed 0.2% by weight, the resultant alloy is deteriorated in the toughness, the thermal shock resistance, the castability and the weldability. Therefore, it is determined that boron and zirconium content should be 0.001 to 0.2% by weight.

Iron: Iron is included as the remainder in the alloy of this invention. Iron has the properties similar to nickel component. Iron is added as the alternative to the expensive nickel component in view of the reduction of the cost.

Each metal components are weighted and heated by the usual high frequency melting furnace under atmospheric pressure at 1400° to 1700° C. for 20 to 30 min. to form the melt. The melt is casted into the sand mold and the casted alloy is prepared each of the test piece for the test. These test piece are used for the many test, such as the hardness, the impact resistance at room temperature, the thermal shock resistance and the wear resistance. The thermal shock resistance test is carried out by the repetition of the rapid heating and the rapid cooling under nearly conditions of the practical machine.

The hardness test is carried out by the measurement of Vickers hardness at room temperature, at 900° C. and at 1000° C. The Ohgoshi type intermetallic wear resistance test is carried out under the load of 18.2 kg, the wear velocity of 0.083 m/sec. at room temperature in the dry condition. The opposited metal having over 57 of Rockwell hardness ($H_RC$) of the metal such as SUJ-2 is used in this test. The amount of the specific wear is estimated by the measurement of the wear resistance to the test piece. Furthermore, the test piece used for thermal shock resistance test is prepared to form in rectangular pillar shape of 12 mm×12 mm×30 mm having the recess of the spherical surface at the center of the pillar end. The thermal shock test comprises to repeating a cycle which the test piece is heated by oxygenpropane gas burner to hold at about 900° C. at the recess of the spherical surface for 30 sec. and thereafter are cooled at once by blowing off with the water spray to hold at about 200° C. at the recess of the spherical surface. This cycle are carried out repeatedly and at every three time the test piece is observed the detection of the crack by the fluorescence permeation at the recess of the spherical surface and measured the occurrence of the crack. If the number of the cycle which the crack occurred at the test piece is over 30, the notation of the thermal shock resistance refers to >30 in the TABLE as follows. In other words, it is meant that the notation of >30 does not are observed the occurrence of the crack at the recess of the spherical surface till the repetition of thermal shock resistance test of 30 times.

The composition and the properties of comparative alloy are showed to compare with the thermal and resistant, tough alloy at elevated temperatures according to this invention in the TABLE. The content of the component put on asteristic sign at the shoulder of the numeral in comparative alloy are showed to have a different composition content from the scope of the alloy according to this invention. Furthermore, the alloy of prior art are showed in the relation with the alloy of this invention. The percentage of content refers to the percentage by weight as follow.

EXAMPLE 1

C-Cr-Ni-Ti-Al-W-Mo-Fe ALLOY

As are shown in TABLE 1-1, TABLE 1-2, TABLE 1-3, and TABLE 1-4, each metal component is weighted, added to mixing, and heated by the usual high frequency melting furnace under the atmosphere to form the melt and thereafter the melt is casted into the sand mold to prepare the casting.

The composition of Nos. 1 to 16 show C-Cr-Ni-Ti-Al-W-Mo-Fc base alloy according to this invention. Furthermore, Nos. 17 to 19 show the abovementioned alloy included silicon and Nos. 22 to 22 show the alloy included manganese and Nos. 23 to 25 show the alloy included nitrogen. Nos. 26 to 61 also show the abovementioned alloy including optionally at least one selected from the group consisting of silicon, manganese, nitrogen, niobium, tantalum, boron and zirconium.

The comparative alloy of Nos. 62 to 70 show to include the content of the composition that the content were without the scope of this invention according to C-Cr-Ni-Ti-Al-W-Mo-Fe alloy.

As are shown in TABLE 2-1, TABLE 2-2, and TABLE 2-3, the results of the properties of the alloy is shown each Vickers hardness at room temperature, at 900° C., and at 1000° C., furthermore Charpy impact strength at room temperature, the amount of the specific wear, and the number of the cycle till the occurrence of the crack.

No. 6 in TABLE 1 consists essentially of 0.79% by weight of carbon, 30.25% of chromium, 25.2% of nickel, 1.79% of titanium, 1.02% of aluminium, 5.36% of tungsten, 3.31% of molybdenum and the balance iron (% refers to percent by weight). The properties of No. 6 alloy is shown in TABLE 2-1. For example, No. 6 alloy show 332 of Vickers hardness at room temperature, 151 at 900° C., 145 at 1000° C., and 1.34 kg-m/cm$^2$ of Charpy impact strength, $1.98\times10^{-7}$ of the amount of the specific wear, >30 of the number of the cycle till the occurrence of the crack.

The comparative alloy of No. 62 consists essentially of 0.49% by weight of carbon, 35.06% of chromium, 30.11% of nickel, 0.59% of titanium, 0.13% of aluminium, 5.60% of tungsten, 4.92% of molybdenum and the balance iron (% refers to percent by weight). This No. 62 showed >30 as the number of the cycle till the occurrence of the crack in TABLE 2-3. The No. 62 also is shown $3.71\times10^{-7}$ of the amount of the specific wear, 0.87 kg-m/cm$^2$ of Charpy impact strength at room temperature, 239 of Vickers hardness at room temperature, 95 at 900° C., and 80 at 1000° C.

The prior art alloy No. 71 consists essentially of 1.32% by weight of carbon, 25.89% of chromium, 11.04% of nickel, 0.50% of molybdenum, 1.59% of silicon, 2.00% of manganese, 0.18% of vanadium and the balance iron (% refers to percent by weight). This No. 71 alloy is shown $3.28\times10^{-7}$ of the amount of the specific ear, 0.89 kg-m/cm$^2$ Charpy impact strength at room temperature, 259 of Vickers hardness at room temperature, 77 at 900° C., and 64 at 1000° C.

These alloys are shown the content of the composition and the properties of the alloy in TABLE 1-1, TABLE 1-2, TABLE 1-3, TABLE 1-4 and TABLE 2-1, TABLE 2-2, TABLE 2-3, respectively.

TABLE 1

| | COMPONENT OF COMPOSITION (% by weight) | | | | | | | | | | | | | | |
|---|---|---|---|---|---|---|---|---|---|---|---|---|---|---|---|
| | C | Cr | Ni | Ti | Al | W | Mo | Si | Mn | N | Nb | Ta | B | Zr | Fe |
| ALLOY OF THIS INVENTION | | | | | | | | | | | | | | | |
| 1 | 0.561 | 35.04 | 30.10 | 0.60 | 0.12 | 5.57 | 4.90 | — | — | — | — | — | — | — | bal. |
| 2 | 1.16 | 35.02 | 30.08 | 0.58 | 0.11 | 5.56 | 4.91 | — | — | — | — | — | — | — | bal. |
| 3 | 1.88 | 35.01 | 30.12 | 0.57 | 0.11 | 5.59 | 4.88 | — | — | — | — | — | — | — | bal. |
| 4 | 0.75 | 28.4 | 30.22 | 0.32 | 0.03 | 5.04 | 4.79 | — | — | — | — | — | — | — | bal. |
| 5 | 0.74 | 38.5 | 30.24 | 0.30 | 0.04 | 5.01 | 4.80 | — | — | — | — | — | — | — | bal. |
| 6 | 0.79 | 30.25 | 25.2 | 1.79 | 1.02 | 5.36 | 3.31 | — | — | — | — | — | — | — | bal. |
| 7 | 0.80 | 30.24 | 48.6 | 1.78 | 1.05 | 5.34 | 3.30 | — | — | — | — | — | — | — | bal. |
| 8 | 0.83 | 30.06 | 44.60 | 0.011 | 4.104 | 4.98 | 2.98 | — | — | — | — | — | — | — | bal. |
| 9 | 0.82 | 30.02 | 44.61 | 4.48 | 0.016 | 4.96 | 2.94 | — | — | — | — | — | — | — | bal. |
| 10 | 0.85 | 30.04 | 47.05 | 4.107 | 0.012 | 4.95 | 2.92 | — | — | — | — | — | — | — | bal. |
| 11 | 0.85 | 30.06 | 47.07 | 1.89 | 2.46 | 4.93 | 2.94 | — | — | — | — | — | — | — | bal. |
| 12 | 0.83 | 30.03 | 47.04 | 0.013 | 4.48 | 4.94 | 2.90 | — | — | — | — | — | — | — | bal. |
| 13 | 1.02 | 35.08 | 35.10 | 0.70 | 0.11 | 0.13 | 7.95 | — | — | — | — | — | — | — | bal. |
| 14 | 1.01 | 35.07 | 35.09 | 0.66 | 0.11 | 7.91 | 2.12 | — | — | — | — | — | — | — | bal. |
| 15 | 1.04 | 35.09 | 35.07 | 0.68 | 0.13 | 7.16 | 0.11 | — | — | — | — | — | — | — | bal. |
| 16 | 1.03 | 35.08 | 35.09 | 0.65 | 0.10 | 1.99 | 8.93 | — | — | — | — | — | — | — | bal. |
| 17 | 1.06 | 31.56 | 40.10 | 1.52 | 0.03 | 2.04 | 5.11 | 0.13 | — | — | — | — | — | — | bal. |
| 18 | 1.02 | 31.55 | 40.07 | 1.51 | 0.05 | 2.06 | 5.13 | 1.51 | — | — | — | — | — | — | bal. |
| 19 | 1.04 | 31.59 | 40.09 | 1.49 | 0.03 | 2.02 | 5.10 | 2.93 | — | — | — | — | — | — | bal. |
| 20 | 0.81 | 31.61 | 35.11 | 1.54 | 0.07 | 2.99 | 6.07 | — | 0.12 | — | — | — | — | — | bal. |

TABLE 1-continued

| | COMPONENT OF COMPOSITION (% by weight) | | | | | | | | | | | | | | |
|---|---|---|---|---|---|---|---|---|---|---|---|---|---|---|---|
| | C | Cr | Ni | Ti | Al | W | Mo | Si | Mn | N | Nb | Ta | B | Zr | Fe |
| 21 | 0.80 | 31.62 | 35.13 | 1.55 | 0.05 | 2.96 | 6.06 | — | 0.87 | — | — | — | — | — | bal. |
| 22 | 0.80 | 31.60 | 35.10 | 1.52 | 0.06 | 2.94 | 6.04 | — | 1.94 | — | — | — | — | — | bal. |
| 23 | 0.82 | 31.50 | 35.11 | 1.51 | 0.12 | 3.05 | 6.04 | — | — | 0.0055 | — | — | — | — | bal. |
| 24 | 0.80 | 31.49 | 35.13 | 1.47 | 0.09 | 3.01 | 6.00 | — | — | 0.016 | — | — | — | — | bal. |
| 25 | 0.78 | 31.47 | 35.10 | 1.46 | 0.10 | 3.00 | 6.01 | — | — | 0.197 | — | — | — | — | bal. |
| 26 | 0.79 | 31.50 | 35.13 | 1.48 | 0.06 | 3.04 | 6.02 | 0.80 | — | 0.015 | — | — | — | — | bal. |
| 27 | 0.80 | 31.51 | 35.10 | 1.50 | 0.05 | 3.01 | 6.00 | — | 0.83 | 0.016 | — | — | — | — | bal. |
| 28 | 0.81 | 31.57 | 35.12 | 1.51 | 0.26 | 3.02 | 6.04 | — | — | — | 0.012 | — | — | — | bal. |
| 29 | 0.80 | 31.56 | 35.11 | 1.50 | 0.24 | 3.01 | 6.02 | — | — | — | 1.04 | — | — | — | bal. |
| 30 | 0.78 | 31.56 | 35.12 | 1.51 | 0.22 | 3.01 | 6.01 | — | — | — | 1.48 | — | — | — | bal. |
| 31 | 0.80 | 31.54 | 35.13 | 1.54 | 0.26 | 3.02 | 6.03 | — | — | — | — | 0.013 | — | — | bal. |
| 32 | 0.83 | 31.52 | 35.15 | 1.52 | 0.24 | 3.01 | 6.02 | — | — | — | — | 1.02 | — | — | bal. |
| 33 | 0.81 | 31.50 | 35.12 | 1.50 | 0.24 | 3.00 | 6.04 | — | — | — | — | 1.45 | — | — | bal. |
| 34 | 0.78 | 31.55 | 35.14 | 1.51 | 0.25 | 3.03 | 6.01 | — | — | — | 0.43 | 0.52 | — | — | bal. |
| 35 | 0.81 | 31.56 | 35.20 | 1.48 | 0.07 | 2.98 | 6.01 | 0.46 | — | — | 0.72 | — | — | — | bal. |
| 36 | 0.80 | 31.53 | 35.17 | 1.50 | 0.05 | 2.99 | 6.03 | 0.42 | — | — | — | 0.85 | — | — | bal. |
| 37 | 0.81 | 31.54 | 35.21 | 1.49 | 0.06 | 2.97 | 6.05 | — | 0.50 | — | 0.64 | — | — | — | bal. |
| 38 | 0.80 | 31.52 | 35.22 | 1.50 | 0.05 | 2.97 | 6.02 | — | 0.51 | — | — | 0.86 | — | — | bal. |
| 39 | 0.79 | 31.52 | 35.20 | 1.48 | 0.06 | 2.95 | 6.01 | 0.45 | — | — | 0.70 | 0.81 | — | — | bal. |
| 40 | 0.80 | 31.51 | 35.21 | 1.50 | 0.32 | 2.96 | 6.02 | — | — | — | — | — | 0.0013 | — | bal. |
| 41 | 0.79 | 31.54 | 35.23 | 1.51 | 0.31 | 2.98 | 6.00 | — | — | — | — | — | 0.099 | — | bal. |
| 42 | 0.81 | 31.50 | 35.21 | 1.48 | 0.29 | 2.96 | 5.99 | — | — | — | — | — | 0.196 | — | bal. |
| 43 | 0.79 | 31.54 | 35.25 | 1.50 | 0.32 | 2.98 | 6.05 | — | — | — | — | — | — | 0.0011 | bal. |
| 44 | 0.79 | 31.51 | 35.23 | 1.48 | 0.32 | 2.97 | 6.04 | — | — | — | — | — | — | 0.094 | bal. |
| 45 | 0.78 | 31.50 | 35.24 | 1.46 | 0.30 | 2.97 | 6.00 | — | — | — | — | — | — | 0.197 | bal. |
| 46 | 0.79 | 31.52 | 35.22 | 1.48 | 0.31 | 2.99 | 6.01 | — | — | — | — | — | 0.041 | 0.031 | bal. |
| 47 | 0.83 | 31.46 | 35.21 | 1.45 | 0.12 | 2.98 | 6.01 | 0.75 | — | — | — | — | 0.0016 | — | bal. |
| 48 | 0.81 | 31.50 | 35.23 | 1.47 | 0.14 | 2.99 | 6.00 | — | 0.72 | — | — | — | — | 0.0014 | bal. |
| 49 | 0.80 | 31.51 | 35.24 | 1.48 | 0.11 | 2.98 | 6.01 | — | 0.70 | — | — | — | 0.0013 | 0.0017 | bal. |
| 50 | 0.78 | 31.49 | 35.21 | 1.50 | 0.36 | 3.00 | 6.01 | — | — | 0.102 | 0.83 | — | — | — | bal. |
| 51 | 0.79 | 31.50 | 35.22 | 1.48 | 0.34 | 3.01 | 6.02 | — | — | 0.105 | — | — | 0.005 | — | bal. |
| 52 | 0.77 | 31.51 | 35.24 | 1.47 | 0.33 | 3.02 | 6.00 | — | — | — | — | 1.07 | — | 0.0028 | bal. |
| 53 | 0.78 | 31.50 | 35.22 | 1.49 | 0.10 | 3.00 | 6.02 | 0.70 | — | 0.013 | — | 1.09 | — | — | bal. |
| 54 | 0.79 | 31.49 | 35.26 | 1.46 | 0.09 | 3.01 | 6.00 | 0.72 | — | 0.007 | — | — | — | 0.096 | bal. |
| 55 | 0.79 | 31.51 | 35.21 | 1.48 | 0.11 | 3.04 | 6.01 | 0.70 | — | — | 0.015 | — | 0.104 | — | bal. |
| 56 | 0.78 | 31.48 | 35.27 | 1.46 | 0.10 | 2.99 | 6.00 | — | 0.81 | 0.006 | — | 0.61 | — | — | bal. |
| 57 | 0.77 | 31.54 | 35.28 | 1.44 | 0.09 | 3.03 | 6.01 | — | 0.79 | 0.009 | — | — | — | 0.0095 | bal. |
| 58 | 0.79 | 31.50 | 35.24 | 1.48 | 0.10 | 3.04 | 5.98 | — | 0.76 | — | 1.10 | — | 0.0060 | 0.0029 | bal. |
| 59 | 0.83 | 31.50 | 35.27 | 1.49 | 0.08 | 3.00 | 6.01 | — | — | 0.007 | 0.05 | 0.18 | — | 0.0022 | bal. |
| 60 | 0.82 | 31.52 | 35.26 | 1.47 | 0.07 | 3.01 | 6.02 | — | 0.36 | 0.007 | — | 0.30 | 0.0013 | 0.0014 | bal. |
| 61 | 0.81 | 31.51 | 35.24 | 1.48 | 0.09 | 3.02 | 6.04 | 0.25 | — | 0.009 | 0.16 | 0.08 | 0.0016 | 0.0012 | bal. |
| COMPARATIVE ALLOY | | | | | | | | | | | | | | | |
| 62 | 0.49* | 35.06 | 30.11 | 0.59 | 0.13 | 5.60 | 4.92 | — | — | — | — | — | — | — | bal. |
| 63 | 2.21* | 35.04 | 30.10 | 0.56 | 0.10 | 5.57 | 4.89 | — | — | — | — | — | — | — | bal. |
| 64 | 0.76 | 26.4* | 30.24 | 0.33 | 0.04 | 5.06 | 4.78 | — | — | — | — | — | — | — | bal. |
| 65 | 0.75 | 41.3* | 30.21 | 0.31 | 0.02 | 5.00 | 4.82 | — | — | — | — | — | — | — | bal. |
| 66 | 0.80 | 30.27 | 24.1* | 1.82 | 1.01 | 5.40 | 3.34 | — | — | — | — | — | — | — | bal. |
| 67 | 0.83 | 30.04 | 44.63 | 5.01* | 0.013 | 4.98 | 2.96 | — | — | — | — | — | — | — | bal. |
| 68 | 0.84 | 30.05 | 47.02 | 0.011 | 5.00* | 4.96 | 2.93 | — | — | — | — | — | — | — | bal. |
| 69 | 1.03 | 35.09 | 35.06 | 0.68 | 0.13 | 9.14* | 2.14 | — | — | — | — | — | — | — | bal. |
| 70 | 1.01 | 35.07 | 35.10 | 0.66 | 0.11 | 1.97 | 9.86* | — | — | — | — | — | — | — | bal. |
| prior art alloy | | | | | | | | | | | | | | | |
| 71 | 1.32 | 25.89 | 11.04 | — | — | — | 0.50 | 1.59 | 2.00 | — | — | — | — | V:0.18 | bal. |
| 72 | 1.28 | 33.92 | bal. | — | — | 3.06 | 2.98 | 0.83 | 0.76 | — | — | — | — | Cu:4.49 | 17.89 |

TABLE 2

| | VICKERS HARDNESS at room temp. | 900° C. | 1000° C. | Charpy impact strength at room temp kg-m/cm$^2$ | Amount of specific wear × $10^{-7}$ | Number of cycle till occurrence of crack |
|---|---|---|---|---|---|---|
| ALLOY OF THIS INVENTION | | | | | | |
| 1 | 317 | 158 | 146 | 1.79 | 1.99 | >30 |
| 2 | 329 | 167 | 150 | 1.71 | 1.82 | >30 |
| 3 | 377 | 246 | 188 | 1.13 | 1.26 | 24 |
| 4 | 328 | 166 | 149 | 1.89 | 1.78 | >30 |
| 5 | 354 | 180 | 176 | 1.58 | 1.40 | >30 |
| 6 | 332 | 151 | 145 | 1.34 | 1.98 | >30 |
| 7 | 356 | 218 | 174 | 2.17 | 1.70 | >30 |
| 8 | 335 | 216 | 161 | 1.98 | 1.51 | 27 |
| 9 | 368 | 248 | 187 | 1.06 | 1.00 | 21 |
| 10 | 356 | 243 | 185 | 1.69 | 1.41 | 27 |
| 11 | 367 | 251 | 192 | 1.57 | 1.28 | 24 |
| 12 | 385 | 265 | 210 | 1.00 | 0.99 | 21 |
| 13 | 374 | 228 | 177 | 1.18 | 1.35 | 30 |

TABLE 2-continued

| | VICKERS HARDNESS at room temp. | 900° C. | 1000° C. | Charpy impact strength at room temp kg-m/cm$^2$ | Amount of specific wear × $10^{-7}$ | Number of cycle till occurrence of crack |
|---|---|---|---|---|---|---|
| 14 | 391 | 256 | 205 | 1.12 | 0.92 | 24 |
| 15 | 378 | 250 | 186 | 1.39 | 1.26 | 30 |
| 16 | 399 | 259 | 208 | 1.16 | 0.97 | 21 |
| 17 | 366 | 227 | 175 | 1.47 | 1.66 | >30 |
| 18 | 371 | 234 | 179 | 1.38 | 1.55 | >30 |
| 19 | 382 | 249 | 181 | 1.26 | 1.39 | 30 |
| 20 | 361 | 234 | 142 | 1.89 | 1.82 | >30 |
| 21 | 356 | 232 | 141 | 1.91 | 1.79 | >30 |
| 22 | 354 | 229 | 139 | 1.99 | 1.68 | >30 |
| 23 | 357 | 235 | 140 | 1.87 | 1.64 | >30 |
| 24 | 364 | 241 | 150 | 1.69 | 1.46 | 27 |
| 25 | 369 | 248 | 164 | 1.00 | 1.31 | 21 |
| 26 | 361 | 244 | 151 | 1.59 | 1.43 | 30 |
| 27 | 359 | 243 | 147 | 1.61 | 1.40 | >30 |

TABLE 2-continued

| | VICKERS HARDNESS at room temp. | 900° C. | 1000° C. | Charpy impact strength at room temp kg-m/cm$^2$ | Amount of specific wear $\times 10^{-7}$ | Number of cycle till occurrence of crack |
|---|---|---|---|---|---|---|
| 28 | 357 | 234 | 141 | 1.88 | 1.67 | >30 |
| 29 | 361 | 238 | 143 | 1.62 | 1.60 | >30 |
| 30 | 374 | 249 | 152 | 1.47 | 1.30 | 30 |
| 31 | 357 | 235 | 141 | 1.98 | 1.67 | >30 |
| 32 | 361 | 239 | 146 | 1.67 | 1.50 | >30 |
| 33 | 376 | 251 | 155 | 1.38 | 1.27 | 30 |
| 34 | 363 | 241 | 144 | 1.69 | 1.59 | >30 |
| 35 | 362 | 239 | 141 | 1.66 | 1.51 | >30 |
| 36 | 361 | 240 | 142 | 1.69 | 1.48 | >30 |
| 37 | 359 | 239 | 141 | 1.70 | 1.57 | >30 |
| 38 | 361 | 241 | 144 | 1.72 | 1.52 | >30 |
| 39 | 363 | 242 | 145 | 1.70 | 1.46 | >30 |
| 40 | 357 | 233 | 141 | 1.86 | 1.61 | >30 |
| 41 | 361 | 238 | 145 | 1.82 | 1.59 | >30 |
| 42 | 368 | 249 | 153 | 1.01 | 1.21 | 24 |
| 43 | 357 | 232 | 139 | 1.90 | 1.63 | >30 |
| 44 | 361 | 239 | 146 | 1.68 | 1.52 | 27 |
| 45 | 368 | 250 | 153 | 1.00 | 1.18 | 21 |
| 46 | 361 | 238 | 142 | 1.77 | 1.40 | >30 |
| 47 | 360 | 236 | 140 | 1.92 | 1.60 | >30 |
| 48 | 358 | 234 | 139 | 1.93 | 1.61 | >30 |
| 49 | 361 | 238 | 143 | 1.87 | 1.56 | >30 |
| 50 | 365 | 245 | 150 | 1.48 | 1.25 | 21 |
| 51 | 368 | 247 | 152 | 1.27 | 1.18 | 21 |
| 52 | 361 | 236 | 143 | 1.79 | 1.50 | >30 |
| 53 | 364 | 241 | 146 | 1.68 | 1.41 | 30 |
| 54 | 360 | 237 | 141 | 1.66 | 1.49 | >30 |
| 55 | 365 | 241 | 143 | 1.72 | 1.32 | 30 |
| 56 | 358 | 237 | 139 | 1.84 | 1.51 | >30 |
| 57 | 360 | 239 | 141 | 1.82 | 1.50 | >30 |
| 58 | 361 | 240 | 143 | 1.83 | 1.48 | >30 |
| 59 | 362 | 241 | 146 | 1.80 | 1.44 | >30 |
| 60 | 372 | 246 | 153 | 1.88 | 1.16 | >30 |
| 61 | 375 | 251 | 155 | 1.90 | 1.10 | >30 |
| | | | | comparative alloy | | |
| 62 | 239 | 95 | 80 | 0.87 | 3.71 | >30 |
| 63 | 422 | 274 | 220 | 0.46 | 0.70 | 9 |
| 64 | 263 | 97 | 86 | 1.87 | 2.56 | >30 |
| 65 | 392 | 216 | 191 | 0.66 | 1.15 | 6 |
| 66 | 283 | 127 | 121 | 0.49 | 2.72 | >30 |
| 67 | 425 | 282 | 220 | 0.36 | 0.77 | 6 |
| 68 | 438 | 293 | 245 | 0.27 | 0.61 | 3 |
| 69 | 409 | 268 | 214 | 0.31 | 0.70 | 6 |
| 70 | 415 | 272 | 217 | 0.25 | 0.68 | 3 |
| | | | | prior art alloy | | |
| 71 | 259 | 77 | 64 | 0.89 | 3.28 | 18 |
| 72 | 305 | 143 | 130 | 0.43 | 1.97 | 3 |

EXAMPLE 2

C-Cr-Ni-Co-Ti-Al-W-Mo-Fe ALLOY

The thermal and wear resistant, tough at elevated temperatures alloy in this invention are shown in EXAMPLE 2. The alloy is different from the content of the composition that the cobalt included one to 8% by weight in comparison with the alloy of EXAMPLE 1.

Alloys of Nos. 73 to 134 according to this invention, the comparative alloys of Nos. 135 to 144 and the prior art alloys of Nos. 145 to 146 are shown in TABLE 3-1, TABLE 3-2, TABLE 3-3 and TABLE 3-4 respectively. Furthermore similar to EXAMPLE 1, the properties of these alloys are shown in TABLE 4-1, TABLE 4-2, TABLE 4-3, respectively. No. 78 alloy in TABLE 3-1 consists essentially of 0.77% by weight of carbon, 30.23% chromium, 25.9% of nickel, 1.61% of cobalt, 1.80% of titanium, 1.00% of aluminium, 5.37% of tungsten, 3.26% of molybdenum and the balance iron (% refers to percent by weight). No. 78 alloy is shown 337 of Vickers hardness at room temperature, 154 at 900° C., and 148 at 1000° C. in TABLE 4-1. No. 78 alloy also is shown 1.37 kg-m/cm$^2$ of Charpy impact strength at room temperature, $1.93\times10^{-7}$ of the amount of the specific wear, >30 of the number of the cycle till the occurrence of the crack. No. 78 alloy is improved in the hardness, the wear resistance at elevated temperatures due to include the content of cobalt in comparison with No. 6 of EXAMPLE 1.

In the comparison with comparative alloys (Nos. 133 to 144) and prior art alloys (Nos. 145 to 146), for example, No. 78 alloy of this invention is shown >30 of the number of the cycle till the occurrence of the crack, 148 of Vickers hardness at 1000° C., on other hand No. 145 alloy of prior art showed 18 of the number of the cycle till the occurrence of the crack.

The scope of the composition in this invention and its properties showed in TABLE 3-1, TABLE 3-2, TABLE 3-3, TABLE 3-4 and TABLE 4-1, TABLE 4-2, TABLE 4-3, respectively.

TABLE 3

| | COMPONENT OF COMPOSITION (% by weight) | | | | | | | | | | | | | | | |
|---|---|---|---|---|---|---|---|---|---|---|---|---|---|---|---|---|
| | C | Cr | Ni | Co | Ti | Al | W | Mo | Si | Mn | N | Nb | Ta | B | Zr | Fe |
| Alloy this invention | | | | | | | | | | | | | | | | |
| 73 | 0.557 | 35.07 | 30.09 | 5.04 | 0.54 | 0.11 | 5.60 | 4.91 | — | — | — | — | — | — | — | bal. |
| 74 | 1.23 | 35.03 | 30.10 | 5.01 | 0.52 | 0.07 | 5.59 | 4.88 | — | — | — | — | — | — | — | bal. |
| 75 | 1.86 | 35.02 | 30.11 | 5.09 | 0.50 | 0.10 | 5.61 | 4.77 | — | — | — | — | — | — | — | bal. |
| 76 | 0.74 | 28.6 | 30.20 | 2.17 | 0.31 | 0.04 | 5.02 | 4.78 | — | — | — | — | — | — | — | bal. |
| 77 | 0.72 | 38.2 | 30.21 | 2.19 | 0.26 | 0.02 | 4.96 | 4.74 | — | — | — | — | — | — | — | bal. |
| 78 | 0.77 | 30.23 | 25.9 | 1.61 | 1.80 | 1.00 | 5.37 | 3.26 | — | — | — | — | — | — | — | bal. |
| 79 | 0.79 | 30.25 | 48.1 | 1.60 | 1.76 | 1.07 | 5.32 | 3.24 | — | — | — | — | — | — | — | bal. |
| 80 | 1.04 | 31.48 | 30.30 | 1.1 | 0.62 | 0.11 | 5.10 | 3.03 | — | — | — | — | — | — | — | bal. |
| 81 | 1.02 | 31.46 | 30.29 | 7.9 | 0.61 | 0.10 | 5.11 | 3.01 | — | — | — | — | — | — | — | bal. |
| 82 | 0.81 | 30.08 | 44.58 | 1.49 | 0.013 | 4.092 | 4.96 | 2.96 | — | — | — | — | — | — | — | bal. |
| 83 | 0.80 | 30.01 | 44.59 | 1.47 | 4.491 | 0.0014 | 4.94 | 2.92 | — | — | — | — | — | — | — | bal. |
| 84 | 0.84 | 30.03 | 47.04 | 1.50 | 4.106 | 0.012 | 4.92 | 2.90 | — | — | — | — | — | — | — | bal. |
| 85 | 0.82 | 30.05 | 47.06 | 1.53 | 0.011 | 4.489 | 4.90 | 2.91 | — | — | — | — | — | — | — | bal. |
| 86 | 1.04 | 35.10 | 35.07 | 5.09 | 0.64 | 0.12 | 0.14 | 7.96 | — | — | — | — | — | — | — | bal. |
| 87 | 1.00 | 35.08 | 35.04 | 5.06 | 0.62 | 0.10 | 7.98 | 2.10 | — | — | — | — | — | — | — | bal. |
| 88 | 1.05 | 35.07 | 35.06 | 5.01 | 0.65 | 0.11 | 7.14 | 0.12 | — | — | — | — | — | — | — | bal. |
| 89 | 1.02 | 35.01 | 35.01 | 5.03 | 0.63 | 0.09 | 2.01 | 8.89 | — | — | — | — | — | — | — | bal. |
| 90 | 1.05 | 31.53 | 40.08 | 5.06 | 1.50 | 0.04 | 2.10 | 5.09 | 0.12 | — | — | — | — | — | — | bal. |
| 91 | 1.01 | 31.54 | 40.04 | 5.08 | 1.51 | 0.06 | 2.11 | 5.07 | 1.53 | — | — | — | — | — | — | bal. |
| 92 | 1.02 | 31.58 | 40.07 | 5.10 | 1.47 | 0.03 | 2.09 | 5.03 | 2.96 | — | — | — | — | — | — | bal. |

TABLE 3-continued

| | COMPONENT OF COMPOSITION (% by weight) | | | | | | | | | | | | | | | |
|---|---|---|---|---|---|---|---|---|---|---|---|---|---|---|---|---|
| | C | Cr | Ni | Co | Ti | Al | W | Mo | Si | Mn | N | Nb | Ta | B | Zr | Fe |
| 93 | 0.80 | 31.59 | 35.10 | 2.01 | 1.52 | 0.08 | 2.98 | 6.10 | — | 0.15 | — | — | — | — | — | bal. |
| 94 | 0.81 | 31.56 | 35.11 | 2.04 | 1.50 | 0.05 | 2.96 | 6.09 | — | 0.96 | — | — | — | — | — | bal. |
| 95 | 0.79 | 31.54 | 35.09 | 2.02 | 1.51 | 0.07 | 2.98 | 6.07 | — | 1.97 | — | — | — | — | — | bal. |
| 96 | 0.81 | 31.48 | 35.09 | 2.10 | 1.50 | 0.11 | 3.02 | 6.02 | — | — | 0.0052 | — | — | — | — | bal. |
| 97 | 0.80 | 31.50 | 35.07 | 2.09 | 1.48 | 0.10 | 3.00 | 6.01 | — | — | 0.103 | — | — | — | — | bal. |
| 98 | 0.79 | 31.49 | 35.06 | 2.07 | 1.46 | 0.11 | 3.01 | 6.02 | — | — | 0.196 | — | — | — | — | bal. |
| 99 | 0.81 | 31.52 | 35.10 | 2.09 | 1.50 | 0.05 | 3.03 | 6.00 | 0.79 | — | 0.014 | — | — | — | — | bal. |
| 100 | 0.83 | 31.50 | 35.09 | 2.07 | 1.49 | 0.06 | 3.02 | 6.01 | — | 0.83 | 0.016 | — | — | — | — | bal. |
| 101 | 0.80 | 31.53 | 35.10 | 2.04 | 1.53 | 0.24 | 3.06 | 6.04 | — | — | — | 0.012 | — | — | — | bal. |
| 102 | 0.79 | 51.54 | 35.08 | 2.02 | 1.54 | 0.23 | 3.04 | 6.01 | — | — | — | 1.03 | — | — | — | bal. |
| 103 | 0.77 | 31.50 | 35.09 | 2.04 | 1.50 | 0.23 | 3.03 | 6.00 | — | — | — | 1.46 | — | — | — | bal. |
| 104 | 0.81 | 31.52 | 35.10 | 2.01 | 1.53 | 0.25 | 3.04 | 6.02 | — | — | — | — | 0.011 | — | — | bal. |
| 105 | 0.82 | 31.51 | 35.09 | 2.03 | 1.52 | 0.23 | 3.02 | 6.04 | — | — | — | — | 0.96 | — | — | bal. |
| 106 | 0.80 | 31.50 | 35.07 | 2.01 | 1.52 | 0.24 | 3.01 | 6.03 | — | — | — | — | 1.46 | — | — | bal. |
| 107 | 0.79 | 31.53 | 35.09 | 2.04 | 1.51 | 0.26 | 3.03 | 6.00 | — | — | — | 0.61 | 0.34 | — | — | bal. |
| 108 | 0.80 | 31.55 | 35.10 | 2.02 | 1.49 | 0.06 | 2.99 | 6.00 | 0.43 | — | — | 0.70 | — | — | — | bal. |
| 109 | 0.81 | 31.54 | 35.11 | 2.04 | 1.50 | 0.07 | 2.98 | 6.01 | 0.40 | — | — | — | 0.84 | — | — | bal. |
| 110 | 0.80 | 31.52 | 35.10 | 2.01 | 1.48 | 0.08 | 2.99 | 6.04 | — | 0.51 | — | 0.67 | — | — | — | bal. |
| 111 | 0.79 | 31.54 | 35.13 | 2.03 | 1.51 | 0.09 | 2.97 | 6.02 | — | 0.53 | — | — | 0.85 | — | — | bal. |
| 112 | 0.78 | 31.51 | 35.12 | 2.00 | 1.49 | 0.07 | 2.96 | 6.00 | 0.42 | — | — | 0.71 | 0.83 | — | — | bal. |
| 113 | 0.81 | 31.50 | 35.08 | 2.02 | 1.49 | 0.31 | 2.96 | 6.03 | — | — | — | — | — | 0.0012 | — | bal. |
| 114 | 0.80 | 31.52 | 35.10 | 2.01 | 1.47 | 0.30 | 2.96 | 6.01 | — | — | — | — | — | 0.096 | — | bal. |
| 115 | 0.80 | 31.49 | 35.09 | 2.00 | 1.48 | 0.30 | 2.95 | 6.02 | — | — | — | — | — | 0.192 | — | bal. |
| 116 | 0.79 | 31.51 | 35.10 | 2.01 | 1.49 | 0.32 | 2.97 | 6.04 | — | — | — | — | — | — | 0.0013 | bal. |
| 117 | 0.77 | 31.52 | 35.09 | 2.03 | 1.47 | 0.31 | 2.98 | 6.03 | — | — | — | — | — | — | 0.103 | bal. |
| 118 | 0.78 | 31.50 | 35.06 | 2.00 | 1.48 | 0.30 | 2.97 | 6.01 | — | — | — | — | — | — | 0.196 | bal. |
| 119 | 0.79 | 31.51 | 35.07 | 2.02 | 1.47 | 0.32 | 2.98 | 6.00 | — | — | — | — | — | 0.039 | 0.028 | bal. |
| 120 | 0.82 | 31.49 | 35.08 | 2.00 | 1.46 | 0.11 | 2.96 | 5.99 | 0.72 | — | — | — | — | 0.0014 | — | bal. |
| 121 | 0.80 | 31.47 | 35.07 | 2.01 | 1.47 | 0.13 | 2.98 | 6.02 | — | 0.70 | — | — | — | — | 0.0015 | bal. |
| 122 | 0.81 | 31.48 | 35.09 | 2.04 | 1.45 | 0.10 | 2.99 | 6.01 | — | 0.69 | — | — | — | 0.0016 | 0.0013 | bal. |
| 123 | 0.79 | 31.50 | 35.10 | 2.02 | 1.47 | 0.34 | 3.02 | 6.00 | — | — | 0.106 | 0.80 | — | — | — | bal. |
| 124 | 0.77 | 31.49 | 35.09 | 2.03 | 1.49 | 0.33 | 3.00 | 6.02 | — | — | 0.103 | — | — | 0.006 | — | bal. |
| 125 | 0.78 | 31.47 | 35.07 | 2.04 | 1.46 | 0.30 | 3.01 | 6.00 | — | — | — | — | 1.00 | — | 0.0026 | bal. |
| 126 | 0.77 | 31.50 | 35.06 | 2.03 | 1.46 | 0.09 | 3.04 | 5.99 | 0.70 | — | 0.010 | — | 1.03 | — | — | bal. |
| 127 | 0.79 | 31.51 | 35.07 | 2.06 | 1.47 | 0.08 | 3.02 | 5.98 | 0.68 | — | 0.009 | — | — | — | 0.094 | bal. |
| 128 | 0.78 | 31.49 | 35.04 | 2.02 | 1.48 | 0.09 | 3.05 | 6.00 | 0.69 | — | — | 0.018 | — | 0.102 | — | bal. |
| 129 | 0.79 | 31.48 | 35.06 | 2.05 | 1.45 | 0.11 | 3.00 | 5.99 | — | 0.76 | 0.007 | — | 0.56 | — | — | bal. |
| 130 | 0.80 | 31.50 | 35.10 | 2.03 | 1.43 | 0.10 | 2.99 | 6.01 | — | 0.77 | 0.008 | — | — | — | 0.0094 | bal. |
| 131 | 0.78 | 31.47 | 35.09 | 2.04 | 1.44 | 0.13 | 2.98 | 5.99 | — | 0.80 | — | 1.02 | — | 0.0051 | 0.0033 | bal. |
| 132 | 0.81 | 31.51 | 35.07 | 2.01 | 1.46 | 0.20 | 2.97 | 6.03 | — | — | 0.006 | 0.03 | 0.15 | — | 0.0021 | bal. |
| 133 | 0.80 | 31.48 | 35.08 | 2.00 | 1.47 | 0.08 | 3.00 | 6.01 | 0.27 | — | 0.007 | 0.16 | — | 0.0014 | 0.0012 | bal. |
| 134 | 0.82 | 31.49 | 35.09 | 2.02 | 1.45 | 0.09 | 3.01 | 6.02 | — | 0.35 | 0.008 | 0.15 | 0.06 | 0.0015 | 0.0013 | bal. |
| comparative alloy | | | | | | | | | | | | | | | | |
| 135 | 0.42* | 35.10 | 30.11 | 5.01 | 0.52 | 0.13 | 5.64 | 5.00 | — | — | — | — | — | — | — | bal. |
| 136 | 2.13* | 35.12 | 30.14 | 5.00 | 0.51 | 0.12 | 5.60 | 4.92 | — | — | — | — | — | — | — | bal. |
| 137 | 0.75 | 26.3* | 30.17 | 2.20 | 0.30 | 0.05 | 5.00 | 4.81 | — | — | — | — | — | — | — | bal. |
| 138 | 0.73 | 40.6* | 30.20 | 2.21 | 0.29 | 0.04 | 4.98 | 4.80 | — | — | — | — | — | — | — | bal. |
| 139 | 0.78 | 30.24 | 23.5* | 1.63 | 1.81 | 1.02 | 5.39 | 3.28 | — | — | — | — | — | — | — | bal. |
| 140 | 1.05 | 31.47 | 30.32 | 0.60* | 0.70 | 0.10 | 5.09 | 3.04 | — | — | — | — | — | — | — | bal. |
| 141 | 0.79 | 30.10 | 44.60 | 1.49 | 4.96* | 0.012 | 4.96 | 2.97 | — | — | — | — | — | — | — | bal. |
| 142 | 0.81 | 30.09 | 47.03 | 1.54 | 0.014 | 4.97* | 4.93 | 2.96 | — | — | — | — | — | — | — | bal. |
| 143 | 1.04 | 35.07 | 35.50 | 5.03 | 0.67 | 0.11 | 9.88* | 2.09 | — | — | — | — | — | — | — | bal. |
| 144 | 1.03 | 35.14 | 35.47 | 5.00 | 0.65 | 0.10 | 2.00 | 10.84* | — | — | — | — | — | — | — | bal. |
| prior art alloy | | | | | | | | | | | | | | | | |
| 145 | 1.32 | 25.89 | 11.04 | — | — | — | — | 0.50 | 1.59 | 2.00 | — | — | — | — | V:0.18 | bal. |
| 146 | 1.28 | 33.92 | bal. | — | — | — | 3.06 | 2.98 | 0.83 | 0.76 | — | — | — | — | Cu:4.94 | 17.89 |

TABLE 4

| | VICKERS HARDNESS at room temp. | 900° C. | 1000° C. | Charpy impact strength at room temp. kg-m/cm² | Amount of specific wear × $10^{-7}$ | Number of cycle till occurrence of crack |
|---|---|---|---|---|---|---|
| Alloy of this invention | | | | | | |
| 73 | 320 | 161 | 150 | 1.80 | 1.96 | >30 |
| 74 | 333 | 170 | 154 | 1.73 | 1.79 | >30 |
| 75 | 380 | 252 | 193 | 1.17 | 1.21 | 27 |
| 76 | 331 | 170 | 153 | 1.92 | 1.72 | >30 |
| 77 | 357 | 184 | 181 | 1.63 | 1.34 | >30 |
| 78 | 337 | 154 | 148 | 1.37 | 1.93 | >30 |
| 79 | 360 | 221 | 179 | 2.26 | 1.67 | >30 |
| 80 | 332 | 168 | 147 | 1.88 | 1.90 | >30 |
| 81 | 351 | 187 | 179 | 1.98 | 1.34 | >30 |
| 82 | 340 | 219 | 165 | 2.01 | 1.47 | 27 |

TABLE 4-continued

| | VICKERS HARDNESS at room temp. | 900° C. | 1000° C. | Charpy impact strength at room temp. kg-m/cm² | Amount of specific wear × $10^{-7}$ | Number of cycle till occurrence of crack |
|---|---|---|---|---|---|---|
| 83 | 371 | 251 | 190 | 1.10 | 0.98 | 21 |
| 84 | 360 | 247 | 188 | 1.79 | 1.39 | 27 |
| 85 | 389 | 268 | 213 | 1.08 | 0.96 | 24 |
| 86 | 377 | 231 | 180 | 1.29 | 1.37 | >30 |
| 87 | 394 | 259 | 208 | 1.20 | 0.89 | 24 |
| 88 | 381 | 254 | 189 | 1.48 | 1.20 | >30 |
| 89 | 402 | 263 | 213 | 1.21 | 0.83 | 24 |
| 90 | 370 | 232 | 178 | 1.50 | 1.62 | >30 |
| 91 | 376 | 237 | 182 | 1.43 | 1.50 | >30 |
| 92 | 385 | 253 | 185 | 1.28 | 1.32 | 30 |
| 93 | 365 | 238 | 146 | 1.96 | 1.77 | >30 |

TABLE 4-continued

| | VICKERS HARDNESS at room temp. | 900° C. | 1000° C. | Charpy impact strength at room temp. kg-m/cm² | Amount of specific wear × $10^{-7}$ | Number of cycle till occurrence of crack |
|---|---|---|---|---|---|---|
| 94 | 360 | 235 | 144 | 1.98 | 1.63 | >30 |
| 95 | 358 | 230 | 143 | 2.00 | 1.52 | >30 |
| 96 | 361 | 237 | 145 | 1.93 | 1.61 | >30 |
| 97 | 367 | 246 | 153 | 1.62 | 1.40 | 27 |
| 98 | 372 | 251 | 167 | 1.09 | 1.26 | 21 |
| 99 | 369 | 248 | 155 | 1.65 | 1.38 | 30 |
| 100 | 368 | 247 | 151 | 1.66 | 1.39 | >30 |
| 101 | 361 | 237 | 145 | 1.99 | 1.61 | >30 |
| 102 | 364 | 241 | 147 | 1.70 | 1.57 | >30 |
| 103 | 377 | 253 | 156 | 1.51 | 1.24 | 30 |
| 104 | 362 | 239 | 146 | 2.00 | 1.60 | >30 |
| 105 | 365 | 242 | 149 | 1.72 | 1.55 | >30 |
| 106 | 379 | 256 | 159 | 1.49 | 1.18 | 30 |
| 107 | 367 | 245 | 150 | 1.74 | 1.50 | >30 |
| 108 | 366 | 243 | 148 | 1.72 | 1.49 | >30 |
| 109 | 366 | 244 | 149 | 1.73 | 1.46 | >30 |
| 110 | 363 | 243 | 147 | 1.75 | 1.56 | >30 |
| 111 | 365 | 245 | 148 | 1.77 | 1.50 | >30 |
| 112 | 367 | 246 | 149 | 1.76 | 1.42 | >30 |
| 113 | 361 | 237 | 145 | 1.97 | 1.58 | >30 |
| 114 | 365 | 241 | 149 | 1.77 | 1.52 | 30 |
| 115 | 371 | 253 | 156 | 1.09 | 1.17 | 24 |
| 116 | 360 | 236 | 143 | 1.96 | 1.59 | >30 |
| 117 | 366 | 243 | 150 | 1.70 | 1.49 | 27 |
| 118 | 373 | 254 | 157 | 1.04 | 1.12 | 21 |
| 119 | 365 | 241 | 146 | 1.87 | 1.47 | >30 |
| 120 | 363 | 240 | 146 | 1.96 | 1.54 | >30 |
| 121 | 362 | 238 | 145 | 1.97 | 1.55 | >30 |
| 122 | 365 | 241 | 147 | 1.98 | 1.53 | >30 |
| 123 | 369 | 248 | 153 | 1.53 | 1.14 | 21 |
| 124 | 371 | 251 | 156 | 1.34 | 1.10 | 21 |
| 125 | 365 | 240 | 146 | 1.87 | 1.41 | >30 |
| 126 | 368 | 244 | 149 | 1.76 | 1.33 | 30 |
| 127 | 364 | 241 | 145 | 1.73 | 1.42 | >30 |
| 128 | 369 | 246 | 147 | 1.80 | 1.27 | 30 |
| 129 | 362 | 240 | 142 | 1.96 | 1.49 | >30 |
| 130 | 364 | 242 | 145 | 1.91 | 1.43 | >30 |
| 131 | 365 | 244 | 147 | 1.93 | 1.40 | >30 |
| 132 | 366 | 245 | 149 | 1.90 | 1.36 | >30 |
| 133 | 378 | 254 | 158 | 1.90 | 1.03 | >30 |
| 134 | 376 | 250 | 156 | 1.93 | 1.05 | >30 |
| | | | Comparative alloy | | | |
| 135 | 243 | 98 | 83 | 0.90 | 3.57 | >30 |
| 136 | 424 | 276 | 223 | 0.50 | 0.63 | 9 |
| 137 | 267 | 101 | 90 | 1.94 | 2.43 | >30 |
| 138 | 396 | 220 | 195 | 0.74 | 1.06 | 6 |
| 139 | 287 | 130 | 124 | 0.42 | 2.61 | >30 |
| 140 | 251 | 110 | 90 | 0.61 | 2.63 | >30 |
| 141 | 428 | 286 | 223 | 0.42 | 0.64 | 6 |
| 142 | 441 | 297 | 248 | 0.31 | 0.55 | 3 |
| 143 | 412 | 271 | 217 | 0.30 | 0.61 | 6 |
| 144 | 419 | 276 | 220 | 0.28 | 0.64 | 3 |
| | | | | prior art alloy | | |
| 145 | 259 | 77 | 64 | 0.89 | 3.28 | 18 |
| 146 | 305 | 143 | 130 | 0.43 | 1.97 | 3 |

EXAMPLE 3

C-Si-Mn-Cr-Ni-Ti-Al-W-Mo-Fe ALLOY

The alloys shown in EXAMPLE 3 are different from the content of the composition that the alloy include silicon and manganese in comparison with the alloy of EXAMPLE 1.

In EXAMPLE 4, the alloys according to this invention (Nos. 147 to 176), the comparative alloys (Nos. 177 to 187) and the prior art alloys (Nos. 188 to 189) are shown in TABLE 5-1, TABLE 5-2, TABLE 5-3 similar to EXAMPLE 1.

No. 152 of TABLE 5-1 consists essentially of 0.80% by weight of carbon, 0.67% of silicon, 0.11% of manganese, 1.03% of titanium, 0 03% of aluminium, 2.98% of tungsten, 6.21% of molybdenum and the balance iron (% refers to percent by weight).

Furthermore, the alloy of Nos. 166 to 176 include optionally at least one selected from the group consisting of 0.005 to 0.2% of nitrogen, 0.01 to 1.5% of niobium and tantalum, 0.001 to 0.2% of boron and zirconium.

The properties of Nos. 147 to 189 alloys are shown in TABLE 6-1, TABLE 6-2 similar to EXAMPLE 1. For example, No. 152 alloy is shown 366 of Vickers hardness at room temperature, 238 at 900° C., 146 at 1000° C. and 1.98 kg-m/cm² of Charpy impact strength at room temperature, $1.79\times10^{-7}$ of the amount of the specific wear and >30 of the number of the cycle till the occurrence of the crack. Alloys of EXAMPLE 3 are shown the component of the composition and its properties in TABLE 5-1, TABLE 5-2, TABLE 5-3 and TABLE 6-1, TABLE 6-2, respectively.

TABLE 5

| | COMPONENT OF COMPOSITION (% by weight) | | | | | | | | | | | | | | |
|---|---|---|---|---|---|---|---|---|---|---|---|---|---|---|---|
| | C | Si | Mn | Cr | Ni | Ti | Al | W | Mo | N | Nb | Ta | B | Zr | Fe |
| Alloy of this invention | | | | | | | | | | | | | | | |
| 147 | 0.558 | 0.68 | 0.77 | 35.1 | 30.0 | 0.56 | 0.11 | 5.60 | 5.00 | — | — | — | — | — | bal. |
| 148 | 1.28 | 0.70 | 0.81 | 35.2 | 30.1 | 0.55 | 0.10 | 5.59 | 4.97 | — | — | — | — | — | bal. |
| 149 | 1.86 | 0.69 | 0.83 | 35.0 | 30.1 | 0.53 | 0.11 | 5.61 | 4.96 | — | — | — | — | — | bal. |
| 150 | 1.03 | 0.12 | 0.51 | 31.5 | 40.0 | 1.07 | 0.04 | 2.10 | 5.12 | — | — | — | — | — | bal. |
| 151 | 1.01 | 2.92 | 0.49 | 31.4 | 40.2 | 1.04 | 0.05 | 2.09 | 5.10 | — | — | — | — | — | bal. |
| 152 | 0.80 | 0.67 | 0.11 | 31.7 | 35.1 | 1.03 | 0.03 | 2.98 | 6.21 | — | — | — | — | — | bal. |
| 153 | 0.79 | 0.68 | 1.93 | 31.6 | 35.2 | 1.08 | 0.02 | 2.96 | 6.20 | — | — | — | — | — | bal. |
| 154 | 0.70 | 0.70 | 0.69 | 28.4 | 30.2 | 0.25 | 0.06 | 5.10 | 4.82 | — | — | — | — | — | bal. |
| 155 | 0.69 | 0.68 | 0.70 | 38.1 | 30.3 | 0.28 | 0.02 | 5.07 | 4.80 | — | — | — | — | — | bal. |
| 156 | 0.76 | 0.80 | 0.83 | 30.2 | 25.3 | 1.75 | 1.00 | 5.32 | 3.25 | — | — | — | — | — | bal. |
| 157 | 0.77 | 0.79 | 0.81 | 30.1 | 45.7 | 1.72 | 1.09 | 5.30 | 3.22 | — | — | — | — | — | bal. |
| 158 | 0.81 | 0.67 | 0.73 | 30.2 | 43.3 | 0.012 | 3.86 | 5.07 | 2.06 | — | — | — | — | — | bal. |
| 159 | 0.80 | 0.66 | 0.70 | 30.1 | 43.2 | 4.43 | 0.05 | 5.01 | 2.03 | — | — | — | — | — | bal. |
| 160 | 0.82 | 0.42 | 0.50 | 30.1 | 45.1 | 3.61 | 0.011 | 5.05 | 2.01 | — | — | — | — | — | bal. |
| 161 | 0.80 | 0.42 | 0.47 | 30.0 | 45.2 | 0.07 | 4.41 | 5.03 | 2.00 | — | — | — | — | — | bal. |
| 162 | 1.03 | 0.68 | 0.76 | 35.1 | 35.1 | 0.61 | 0.22 | 0.11 | 7.93 | — | — | — | — | — | bal. |
| 163 | 1.00 | 0.67 | 0.78 | 35.0 | 35.1 | 0.60 | 0.24 | 7.94 | 1.98 | — | — | — | — | — | bal. |
| 164 | 0.98 | 0.70 | 0.69 | 34.1 | 35.2 | 0.63 | 0.17 | 7.11 | 0.12 | — | — | — | — | — | bal. |
| 165 | 0.96 | 0.69 | 0.72 | 34.0 | 35.1 | 0.62 | 0.16 | 1.87 | 8.89 | — | — | — | — | — | bal. |

TABLE 5-continued

| | COMPONENT OF COMPOSITION (% by weight) | | | | | | | | | | | | | | |
|---|---|---|---|---|---|---|---|---|---|---|---|---|---|---|---|
| | C | Si | Mn | Cr | Ni | Ti | Al | W | Mo | N | Nb | Ta | B | Zr | Fe |
| 166 | 1.06 | 0.67 | 0.80 | 35.0 | 30.1 | 0.37 | 0.10 | 5.48 | 5.10 | 0.083 | — | — | — | — | bal. |
| 167 | 1.07 | 0.77 | 0.76 | 34.9 | 30.2 | 0.40 | 0.11 | 5.47 | 5.11 | — | 0.84 | — | — | — | bal. |
| 168 | 1.08 | 0.78 | 0.74 | 34.9 | 30.1 | 0.38 | 0.10 | 5.50 | 5.08 | — | — | 0.76 | — | — | bal. |
| 169 | 1.06 | 0.79 | 0.76 | 35.0 | 30.3 | 0.39 | 0.09 | 5.51 | 5.10 | — | 0.41 | 0.40 | — | — | bal. |
| 170 | 1.07 | 0.76 | 0.77 | 34.9 | 30.2 | 0.38 | 0.10 | 5.50 | 5.11 | — | — | — | 0.083 | — | bal. |
| 171 | 1.08 | 0.77 | 0.78 | 35.1 | 30.3 | 0.37 | 0.10 | 5.49 | 5.09 | — | — | — | — | 0.013 | bal. |
| 172 | 1.06 | 0.75 | 0.79 | 35.0 | 30.2 | 0.39 | 0.08 | 5.50 | 5.12 | — | — | — | 0.002 | 0.004 | bal. |
| 173 | 1.07 | 0.74 | 0.84 | 35.1 | 30.1 | 0.40 | 0.10 | 5.47 | 5.10 | 0.009 | — | 0.96 | — | — | bal. |
| 174 | 1.05 | 0.73 | 0.82 | 34.8 | 30.2 | 0.37 | 0.07 | 5.46 | 5.07 | 0.104 | — | — | — | 0.075 | bal. |
| 175 | 1.06 | 0.74 | 0.80 | 34.9 | 30.1 | 0.39 | 0.11 | 5.50 | 5.09 | 0.008 | 0.69 | — | 0.071 | — | bal. |
| 176 | 1.05 | 0.75 | 0.78 | 35.0 | 30.3 | 0.38 | 0.10 | 5.48 | 3.10 | 0.069 | 0.48 | — | 0.015 | 0.104 | bal. |
| COMPARATIVE ALLOY | | | | | | | | | | | | | | | |
| 177 | 0.41* | 0.69 | 0.80 | 35.1 | 30.1 | 0.50 | 0.10 | 5.57 | 4.98 | — | — | — | — | — | bal. |
| 178 | 2.36* | 0.70 | 0.78 | 35.0 | 30.0 | 0.51 | 0.09 | 5.56 | 4.99 | — | — | — | — | — | bal. |
| 179 | 1.04 | 4.23* | 0.51 | 31.5 | 40.2 | 1.03 | 0.04 | 2.10 | 5.11 | — | — | — | — | — | bal. |
| 180 | 0.80 | 0.67 | 3.03* | 31.7 | 35.1 | 1.09 | 0.03 | 2.98 | 6.18 | — | — | — | — | — | bal. |
| 181 | 0.69 | 0.71 | 0.73 | 26.1* | 30.1 | 0.28 | 0.05 | 5.09 | 4.89 | — | — | — | — | — | bal. |
| 182 | 0.70 | 0.70 | 0.71 | 41.3* | 30.2 | 0.30 | 0.03 | 5.08 | 4.85 | — | — | — | — | — | bal. |
| 183 | 0.80 | 0.77 | 0.84 | 30.1 | 22.4* | 1.78 | 1.04 | 5.31 | 3.27 | — | — | — | — | — | bal. |
| 184 | 0.79 | 0.68 | 0.73 | 30.1 | 43.2 | 5.13* | 0.06 | 5.00 | 2.04 | — | — | — | — | — | bal. |
| 185 | 0.79 | 0.41 | 0.50 | 30.1 | 45.3 | 0.08 | 5.26* | 5.01 | 2.02 | — | — | — | — | — | bal. |
| 186 | 1.01 | 0.70 | 0.76 | 35.1 | 35.2 | 0.62 | 0.28 | 9.04* | 1.99 | — | — | — | — | — | bal. |
| 187 | 0.98 | 0.71 | 0.70 | 34.0 | 35.0 | 0.61 | 0.17 | 1.86 | 10.03* | — | — | — | — | — | bal. |
| prior art alloy | | | | | | | | | | | | | | | |
| 188 | 1.32 | 1.59 | 2.00 | 25.9 | 11.0 | — | — | — | 0.50 | — | — | — | — | V: 0.18 | bal. |
| 189 | 1.28 | 0.83 | 0.76 | 34.0 | bal. | — | — | 3.06 | 2.98 | — | — | — | — | Cu: 4.94 | 17.9 |

TABLE 6

| | VICKERS HARDNESS | | | Charpy impact strength at room temp. kg-m/cm$^2$ | Amount of specific wear $\times 10^{-7}$ | Number of cycle till occurrence of crack |
|---|---|---|---|---|---|---|
| | at room temp. | 900° C. | 1000° C. | | | |
| ALLOY OF THIS INVENTION | | | | | | |
| 147 | 318 | 160 | 149 | 1.81 | 1.96 | >30 |
| 148 | 331 | 168 | 155 | 1.76 | 1.73 | >30 |
| 149 | 379 | 253 | 192 | 1.23 | 0.98 | 27 |
| 150 | 374 | 235 | 181 | 1.39 | 1.52 | >30 |
| 151 | 383 | 251 | 183 | 1.31 | 1.37 | 30 |
| 152 | 366 | 238 | 146 | 1.98 | 1.79 | >30 |
| 153 | 357 | 230 | 141 | 2.01 | 1.53 | >30 |
| 154 | 332 | 171 | 154 | 1.93 | 1.72 | >30 |
| 155 | 360 | 187 | 183 | 1.52 | 1.34 | 30 |
| 156 | 338 | 156 | 150 | 1.34 | 1.91 | >30 |
| 157 | 360 | 221 | 179 | 2.26 | 1.63 | >30 |
| 158 | 356 | 235 | 144 | 1.96 | 1.50 | 30 |
| 159 | 369 | 251 | 192 | 1.20 | 0.96 | 27 |
| 160 | 350 | 231 | 140 | 1.99 | 1.54 | >30 |
| 161 | 385 | 261 | 200 | 1.14 | 0.93 | 24 |
| 162 | 378 | 238 | 183 | 1.26 | 1.29 | 30 |
| 163 | 394 | 263 | 210 | 1.20 | 0.89 | 24 |
| 164 | 382 | 255 | 190 | 1.48 | 1.24 | 30 |
| 165 | 402 | 264 | 213 | 1.16 | 0.86 | 24 |
| 166 | 356 | 184 | 148 | 1.90 | 1.70 | >30 |
| 167 | 348 | 218 | 185 | 1.38 | 1.46 | >30 |
| 168 | 350 | 215 | 180 | 1.51 | 1.49 | >30 |
| 169 | 362 | 234 | 189 | 1.36 | 1.10 | >30 |
| 170 | 351 | 207 | 178 | 1.40 | 1.02 | 27 |
| 171 | 346 | 192 | 173 | 1.31 | 1.08 | 27 |
| 172 | 364 | 208 | 186 | 1.26 | 1.00 | 24 |
| 173 | 379 | 237 | 187 | 1.30 | 0.99 | 27 |
| 174 | 393 | 270 | 202 | 1.08 | 0.95 | 21 |
| 175 | 373 | 215 | 192 | 1.29 | 1.02 | 24 |
| 176 | 403 | 282 | 214 | 1.20 | 0.86 | 21 |
| COMPARATIVE ALLOY | | | | | | |
| 177 | 248 | 97 | 83 | 0.99 | 3.83 | >30 |
| 178 | 421 | 276 | 224 | 0.53 | 0.70 | 12 |
| 179 | 420 | 257 | 200 | 0.75 | 1.03 | 9 |
| 180 | 324 | 148 | 123 | 2.09 | 1.14 | >30 |
| 181 | 267 | 100 | 89 | 1.98 | 2.53 | >30 |
| 182 | 394 | 219 | 192 | 0.81 | 1.12 | 6 |
| 183 | 286 | 128 | 125 | 0.47 | 2.68 | >30 |
| 184 | 418 | 279 | 218 | 0.56 | 0.81 | 6 |
| 185 | 427 | 286 | 238 | 0.47 | 0.90 | 3 |
| 186 | 413 | 271 | 218 | 0.44 | 0.66 | 6 |
| 187 | 418 | 276 | 221 | 0.36 | 0.71 | 3 |
| prior art alloy | | | | | | |
| 188 | 259 | 77 | 64 | 0.89 | 3.28 | 18 |
| 189 | 305 | 143 | 130 | 0.43 | 1.97 | 3 |

EXAMPLE 4

C-Si-Mn-Cr-Ni-Co-W-Mo-Ti-Al-Fe ALLOY

The alloys shown in EXAMPLE 4 are different from the content of the composition that the alloys include one to 8% by weight in comparison with alloys of EXAMPLE 3. Alloys of this invention (Nos. 192 to 222), comparative alloys (Nos. 224 to 235), and prior art alloys (Nos. 190 to 191) are shown the component of the composition in TABLE 7-1, TABLE 7-2, and TABLE 7-3. The properties of alloys are shown in TABLE 8-1 and TABLE 8-2.

No. 199 alloy consists essentially of 0.70% by weight of carbon, 0.68% of silicon, 0.70% of manganese, 28.97% of chromium, 30.12% of nickel, 2.15% of cobalt, 5.06% of tungsten, 4.80% of molybdenum, 0.23% of titanium, 0.05% of aluminium, and the balance iron (% refers to percent by weight).

Furthermore, alloys of Nos. 224 to 235 include optionally at least one selected from the group consisting of 0.005 to 0.2% of nitrogen, 0.01 to 1.5% of niobium and tantalum, and 0.001 to 0.2% of boron and zirconium.

The properties of Nos. 190 to 235 alloys are shown in TABLE 8-1 and TABLE 8-2 similar to EXAMPLE 1.

For example, No. 199 alloy is shown 336 of Vickers hardness at room temperature, 175 at 900° C., 158 at 1000° C. and 1.87 k-gm/cm$^2$ of Charpy impact strength at room temperature $1.67\times10^{-7}$ of the amount of the specific wear, and >30 of the number of the cycle till the occurrence of the crack No. 199 in EXAMPLE 4 include 2.15% by weight of cobalt in comparison with alloy having similar composition of No. 154 in EXAMPLE 3. No. 154 alloy is shown 332 of Vickers hardness at room temperature, 171 at 900° C., 154 at 1000° C. Furthermore No. 154 alloy shows 1.93 kg-m/cm$^2$ of Charpy impact strength at room temperature, $1.72\times10^{-7}$ of the amount of the specific wear, >30 of the number of the cycle till the occurrence of the crack. The component of the composition and its properties are shown in TABLE 7-1, TABLE 7-2, TABLE 7-3 and TABLE 8-1, TABLE 8-2, respectively.

TABLE 8

| | VICKERS HARDNESS at room temp. | 900° C. | 1000° C. | Charpy impact strength at room temp. kg-m/cm$^2$ | Amount of specific wear $\times 10^{-7}$ | Number of cycle till occurrence of crack |
|---|---|---|---|---|---|---|
| prior art alloy | | | | | | |
| 190 | 259 | 77 | 64 | 0.89 | 3.28 | 18 |
| 191 | 305 | 143 | 130 | 0.43 | 1.97 | 3 |
| ALLOY OF THIS INVENTION | | | | | | |
| 192 | 322 | 163 | 152 | 1.78 | 1.90 | >30 |
| 193 | 336 | 172 | 158 | 1.70 | 1.71 | >30 |
| 194 | 383 | 256 | 196 | 1.14 | 0.94 | 27 |
| 195 | 379 | 239 | 184 | 1.33 | 1.47 | >30 |
| 196 | 387 | 254 | 187 | 1.26 | 1.30 | 30 |
| 197 | 369 | 241 | 149 | 1.93 | 1.72 | >30 |
| 198 | 360 | 233 | 145 | 1.99 | 1.48 | >30 |
| 199 | 336 | 175 | 158 | 1.87 | 1.67 | >30 |
| 200 | 362 | 190 | 187 | 1.41 | 1.22 | 30 |
| 201 | 341 | 160 | 153 | 1.26 | 1.80 | >30 |

TABLE 7

| | COMPONENT OF COMPOSITION (% by weight) | | | | | | | | | | | | | | | | | |
|---|---|---|---|---|---|---|---|---|---|---|---|---|---|---|---|---|---|---|
| | C | Si | Mn | Cr | Ni | Co | W | Mo | Ti | Al | N | Nb | Ta | B | Zr | Cu | V | Fe |
| prior art alloy | | | | | | | | | | | | | | | | | | |
| 190 | 1.32 | 1.59 | 2.00 | 25.89 | 11.04 | — | — | 0.50 | — | — | — | — | — | — | — | — | 0.18 | bal. |
| 191 | 1.28 | 0.83 | 0.76 | 33.92 | bal. | — | 3.06 | 2.98 | — | — | — | — | — | — | — | 4.94 | — | 17.89 |
| ALLOY OF THIS INVENTION | | | | | | | | | | | | | | | | | | |
| 192 | 0.56 | 0.70 | 0.79 | 35.03 | 30.10 | 5.01 | 5.56 | 4.94 | 0.51 | 0.10 | — | — | — | — | — | — | — | bal. |
| 193 | 1.22 | 0.71 | 0.83 | 35.00 | 30.09 | 5.03 | 5.62 | 4.86 | 0.50 | 0.09 | — | — | — | — | — | — | — | bal. |
| 194 | 1.85 | 0.15 | 0.82 | 35.05 | 30.08 | 5.12 | 5.59 | 4.80 | 0.53 | 0.11 | — | — | — | — | — | — | — | bal. |
| 195 | 1.01 | 1.60 | 0.49 | 31.57 | 40.12 | 5.04 | 2.04 | 5.11 | 1.04 | 0.04 | — | — | — | — | — | — | — | bal. |
| 196 | 1.00 | 2.70 | 0.46 | 31.50 | 40.13 | 5.00 | 2.01 | 5.14 | 1.03 | 0.05 | — | — | — | — | — | — | — | bal. |
| 197 | 0.78 | 0.65 | 0.11 | 31.60 | 35.07 | 2.00 | 3.00 | 6.15 | 1.02 | 0.04 | — | — | — | — | — | — | — | bal. |
| 198 | 0.80 | 0.66 | 1.70 | 31.59 | 35.06 | 2.03 | 2.99 | 6.16 | 1.00 | 0.06 | — | — | — | — | — | — | — | bal. |
| 199 | 0.70 | 0.68 | 0.70 | 28.97 | 30.12 | 2.15 | 5.06 | 4.80 | 0.23 | 0.05 | — | — | — | — | — | — | — | bal. |
| 200 | 0.71 | 0.67 | 0.71 | 37.98 | 30.15 | 2.16 | 5.00 | 4.81 | 0.20 | 0.01 | — | — | — | — | — | — | — | bal. |
| 201 | 0.75 | 0.79 | 0.82 | 30.14 | 25.10 | 1.59 | 5.31 | 3.23 | 1.74 | 1.02 | — | — | — | — | — | — | — | bal. |
| 202 | 0.74 | 0.78 | 0.81 | 30.12 | 47.93 | 1.57 | 5.29 | 3.25 | 1.70 | 1.10 | — | — | — | — | — | — | — | bal. |
| 203 | 1.02 | 0.68 | 0.80 | 31.50 | 30.24 | 1.60 | 5.07 | 2.99 | 0.59 | 0.10 | — | — | — | — | — | — | — | bal. |
| 204 | 1.03 | 0.71 | 0.79 | 31.51 | 30.25 | 7.91 | 5.09 | 2.98 | 0.60 | 0.09 | — | — | — | — | — | — | — | bal. |
| 205 | 1.02 | 0.70 | 0.80 | 34.97 | 35.00 | 5.01 | 0.52 | 7.95 | 0.57 | 0.10 | — | — | — | — | — | — | — | bal. |
| 206 | 1.01 | 0.69 | 0.81 | 34.94 | 35.02 | 5.04 | 7.96 | 2.00 | 0.59 | 0.11 | — | — | — | — | — | — | — | bal. |
| 207 | 0.99 | 0.67 | 0.70 | 34.01 | 35.02 | 4.96 | 7.00 | 0.87 | 0.61 | 0.09 | — | — | — | — | — | — | — | bal. |
| 208 | 0.98 | 0.69 | 0.69 | 34.04 | 35.00 | 4.94 | 2.09 | 8.01 | 0.60 | 0.08 | — | — | — | — | — | — | — | bal. |
| 209 | 0.81 | 0.80 | 0.79 | 30.12 | 42.11 | 1.60 | 5.00 | 2.99 | 0.91 | 0.09 | — | — | — | — | — | — | — | bal. |
| 210 | 0.82 | 0.77 | 0.78 | 30.11 | 42.10 | 1.51 | 5.03 | 2.98 | 3.34 | 0.07 | — | — | — | — | — | — | — | bal. |
| 211 | 0.80 | 0.80 | 0.79 | 30.08 | 45.01 | 1.53 | 5.04 | 3.04 | 0.52 | 1.57 | — | — | — | — | — | — | — | bal. |
| 212 | 0.81 | 0.78 | 0.76 | 30.07 | 45.03 | 1.51 | 5.02 | 3.01 | 0.018 | 3.31 | — | — | — | — | — | — | — | bal. |
| 213 | 1.07 | 0.69 | 0.81 | 34.99 | 30.08 | 5.00 | 5.53 | 4.97 | 0.31 | 0.08 | 0.110 | — | — | — | — | — | — | bal. |
| 214 | 1.06 | 0.67 | 0.80 | 34.97 | 30.06 | 5.03 | 5.54 | 4.99 | 0.33 | 0.06 | — | — | 0.71 | — | — | — | — | bal. |
| 215 | 1.09 | 0.68 | 0.79 | 34.99 | 30.07 | 5.01 | 5.50 | 5.00 | 0.30 | 0.08 | — | 0.80 | — | — | — | — | — | bal. |
| 216 | 1.08 | 0.78 | 0.77 | 34.96 | 30.04 | 5.00 | 5.53 | 4.99 | 0.32 | 0.08 | — | 0.31 | 0.44 | — | — | — | — | bal. |
| 217 | 1.09 | 0.72 | 0.79 | 35.03 | 30.08 | 5.04 | 5.51 | 4.96 | 0.31 | 0.07 | — | — | — | 0.089 | — | — | — | bal. |
| 218 | 1.07 | 0.69 | 0.77 | 34.99 | 30.09 | 5.01 | 5.50 | 4.99 | 0.26 | 0.09 | — | — | — | — | 0.102 | — | — | bal. |
| 219 | 1.06 | 0.70 | 0.78 | 34.96 | 30.10 | 5.00 | 5.49 | 4.98 | 0.31 | 0.07 | — | — | — | 0.039 | 0.055 | — | — | bal. |
| 220 | 1.08 | 0.71 | 0.80 | 35.01 | 30.11 | 5.02 | 5.51 | 5.01 | 0.29 | 0.09 | 0.069 | 1.09 | — | — | — | — | — | bal. |
| 221 | 1.09 | 0.69 | 0.70 | 35.00 | 30.07 | 5.02 | 5.53 | 5.00 | 0.30 | 0.09 | 0.082 | — | — | 0.092 | — | — | — | bal. |
| 222 | 1.07 | 0.68 | 0.74 | 35.02 | 30.08 | 5.01 | 5.50 | 5.01 | 0.32 | 0.08 | — | — | 0.92 | — | 0.087 | — | — | bal. |
| 223 | 1.09 | 0.70 | 0.77 | 35.00 | 30.10 | 5.03 | 5.49 | 5.03 | 0.30 | 0.09 | 0.072 | 0.57 | 0.30 | 0.054 | 0.045 | — | — | bal. |
| COMPARATIVE ALLOY | | | | | | | | | | | | | | | | | | |
| 224 | 0.28* | 0.69 | 0.78 | 35.00 | 30.17 | 5.06 | 5.57 | 4.96 | 0.50 | 0.08 | — | — | — | — | — | — | — | bal. |
| 225 | 2.06* | 0.71 | 0.80 | 34.98 | 30.12 | 5.11 | 5.59 | 4.90 | 0.52 | 0.08 | — | — | — | — | — | — | — | bal. |
| 226 | 1.02 | 4.23* | 0.51 | 31.58 | 40.10 | 4.97 | 2.01 | 5.13 | 1.01 | 0.05 | — | — | — | — | — | — | — | bal. |
| 227 | 0.71 | 0.66 | 3.08* | 31.55 | 35.04 | 2.05 | 3.00 | 6.18 | 0.99 | 0.07 | — | — | — | — | — | — | — | bal. |
| 228 | 0.73 | 0.68 | 0.71 | 25.01* | 30.03 | 2.11 | 5.04 | 4.79 | 0.25 | 0.06 | — | — | — | — | — | — | — | bal. |
| 229 | 0.70 | 0.67 | 0.70 | 40.89* | 30.10 | 2.12 | 5.06 | 4.80 | 0.21 | 0.04 | — | — | — | — | — | — | — | bal. |
| 230 | 0.73 | 0.80 | 0.80 | 30.10 | 20.01* | 1.56 | 5.30 | 3.01 | 1.68 | 1.02 | — | — | — | — | — | — | — | bal. |
| 231 | 1.00 | 0.71 | 0.81 | 31.54 | 30.06 | 0.31* | 5.09 | 2.97 | 0.57 | 0.09 | — | — | — | — | — | — | — | bal. |
| 232 | 1.02 | 0.73 | 0.78 | 34.97 | 35.01 | 5.02 | 9.97* | 2.01 | 0.61 | 0.10 | — | — | — | — | — | — | — | bal. |
| 233 | 1.00 | 0.70 | 0.68 | 34.03 | 35.03 | 4.96 | 2.08 | 9.88* | 0.58 | 0.08 | — | — | — | — | — | — | — | bal. |
| 234 | 0.80 | 0.76 | 0.79 | 30.09 | 42.03 | 1.50 | 5.01 | 2.96 | 4.00* | 0.07 | — | — | — | — | — | — | — | bal. |
| 235 | 0.79 | 0.81 | 0.78 | 30.10 | 45.00 | 1.56 | 5.03 | 3.06 | 0.51 | 4.02* | — | — | — | — | — | — | — | bal. |

TABLE 8-continued

| | VICKERS HARDNESS at room temp. | 900° C. | 1000° C. | Charpy impact strength at room temp. kg-m/cm$^2$ | Amount of specific wear × $10^{-7}$ | Number of cycle till occurrence of crack |
|---|---|---|---|---|---|---|
| 202 | 364 | 226 | 183 | 2.13 | 1.50 | >30 |
| 203 | 338 | 174 | 150 | 1.82 | 1.83 | >30 |
| 204 | 357 | 192 | 183 | 1.95 | 1.29 | >30 |
| 205 | 381 | 240 | 186 | 1.21 | 1.26 | 30 |
| 206 | 398 | 264 | 213 | 1.18 | 0.87 | 24 |
| 207 | 386 | 259 | 194 | 1.42 | 1.13 | 30 |
| 208 | 406 | 268 | 218 | 1.13 | 0.81 | 24 |
| 209 | 341 | 218 | 166 | 2.08 | 1.51 | >30 |
| 210 | 370 | 252 | 193 | 1.24 | 1.00 | 24 |
| 211 | 362 | 248 | 189 | 1.81 | 1.43 | 30 |
| 212 | 386 | 263 | 201 | 1.18 | 0.98 | 27 |
| 213 | 381 | 253 | 166 | 1.24 | 1.00 | 27 |
| 214 | 354 | 218 | 183 | 1.38 | 1.42 | >30 |
| 215 | 351 | 221 | 189 | 1.26 | 1.40 | 30 |
| 216 | 366 | 237 | 193 | 1.38 | 1.08 | >30 |
| 217 | 354 | 210 | 182 | 1.31 | 1.00 | 30 |
| 218 | 356 | 207 | 188 | 1.23 | 1.02 | 24 |
| 219 | 368 | 211 | 189 | 1.21 | 0.96 | 24 |
| 220 | 384 | 242 | 190 | 1.28 | 0.98 | 27 |
| 221 | 394 | 271 | 203 | 1.19 | 0.94 | 24 |
| 222 | 377 | 219 | 196 | 1.24 | 1.00 | 24 |
| 223 | 407 | 286 | 218 | 1.17 | 0.80 | 21 |
| | | | COMPARATIVE ALLOY | | | |
| 224 | 250 | 100 | 85 | 0.93 | 3.51 | >30 |
| 225 | 426 | 278 | 226 | 0.51 | 0.67 | 12 |
| 226 | 424 | 260 | 203 | 0.73 | 1.00 | 9 |
| 227 | 328 | 153 | 127 | 2.03 | 1.04 | >30 |
| 228 | 270 | 104 | 92 | 1.96 | 2.41 | >30 |
| 229 | 398 | 223 | 197 | 0.76 | 1.02 | 6 |
| 230 | 290 | 133 | 128 | 0.40 | 2.55 | >30 |
| 231 | 254 | 114 | 92 | 0.64 | 2.67 | >30 |
| 232 | 415 | 274 | 220 | 0.34 | 0.63 | 6 |
| 233 | 421 | 279 | 223 | 0.30 | 0.69 | 3 |
| 234 | 417 | 278 | 216 | 0.58 | 0.83 | 6 |
| 235 | 426 | 285 | 236 | 0.49 | 0.92 | 3 |

ABILITY OF INDUSTRIAL UTILITY

The alloy of this invention are employed for the guide shoe included the pierced billet used in a hot rolling apparatus for fabricating seamless steel pipe due to improve in the thermal and wear resistance, toughness at elevated temperatures.

The alloy of this invention have the industrial utilizable properties and the extremely long life and the stability. Furthermore, the alloy according to this invention is applied widely to employing for the build-up weld.

We claim:

1. A thermal and wear resistant, tough alloy at elevated temperatures consisting essentially of 0.65 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% of tungsten, 0.1 to 9% by weight of molybdenum and the balance iron and incidental impurities, the alloy including up to 3% by weight of silicon up to 2% by weight of manganese, up to 8% by weight of cobalt, up to 0.2% by weight of nitrogen, up to 1.5% by weight of niobium and tantalum and up to 0.2% by weight of boron and zirconium.

2. The thermal and wear resistant, tough alloy at elevated temperatures consisting essentially of 0.65 to 1.9% by weight of carbon, 28 to 319% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum and the balance iron and incidental impurities.

3. The alloy as defined in claim 2, wherein further said alloy is included 0.005 to 0.2% by weight of nitrogen.

4. The alloy as defined in claim 2, wherein further said alloy are included at least one selected from the group consisting of 0.01 to 1.5% by weight of niobium and tantalum.

5. The alloy as defined in claim 2, wherein further said alloy are included at least one selected from the group consisting of 0.001 to 0.2% by weight of boron and zirconium.

6. The alloy as defined in claim 3, wherein further said alloy are included at least one selected from the group consisting of 0.01 to 1.5% by weight of niobium and tantalum.

7. The alloy as defined in claim 3, wherein further said alloy are included at least one selected from the group consisting of 0.001 to 0.2% by weight of boron and zirconium.

8. The alloy as defined in claim 4, wherein further said alloy are included at least one selected from the group consisting of 0.001 to 0.2% by weight of boron and zirconium.

9. The alloy as defined in claim 6, wherein further said alloy are included at least one selected from the group consisting of 0.001 to 0.2% by weight of boron and zirconium.

10. The thermal and wear resistant, tough alloy at elevated temperatures consisting essentially of 0.65 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, 0.1 to 3% by weight of silicon and the balance iron and incidental impurities.

11. The alloy as defined in claim 10, wherein further said alloy is included 0.005 to 0.2% by weight of nitrogen.

12. The alloy as defined in claim 10, wherein further said alloy are included at least one selected from the group consisting of 0.01 to 1.5% by weight of niobium and tantalum.

13. The alloy as defined in claim 10, wherein further said alloy are included at least one selected from the group consisting of 0.001 to 0.2% by weight of boron and zirconium.

14. The alloy as defined in claim 11, wherein further said alloy are included at least one selected from the group consisting of 0.01 to 1.5% by weight of niobium and tantalum.

15. The alloy as defined in claim 11, wherein further said alloy are included at least one selected from the group consisting of 0.001 to 0.2% by weight of boron and zirconium.

16. The alloy as defined in claim 12, wherein further said alloy are included at least one selected from the group consisting of 0.001 to 0.2% by weight of boron and zirconium.

17. The alloy as defined in claim 14, wherein further said alloy are included at least one selected from the group consisting of 0.001 to 0.2% by weight of boron and zirconium.

18. The thermal and wear resistant, tough alloy at elevated temperatures consisting essentially of 0.7 to 1.9% by weight of carbon, 28 to 39% by weight of chromium, 25 to 49% by weight of nickel, 0.01 to 4.5% by weight of titanium, 0.01 to 4.5% by weight of aluminium 0.1 to 8% by weight of tungsten, 0.1 to 9% by weight of molybdenum, 0.1 to 2% by weight of manganese and the balance iron and incidental impurities.

19. The alloy as defined in claim 18, wherein further said alloy is included 0.005 to 0.2% by weight of nitrogen.

20. The alloy as defined in claim 18, wherein further said alloy are included at least one selected from the group consisting of 0.01 to 1.5% by weight of niobium and tantalum.

21. The alloy as defined in claim 18, wherein further said alloy are included at least one selected from the group consisting of 0.001 to 0.2% by weight of boron and zirconium.

22. The alloy as defined in claim 19, wherein further said alloy are included at least one selected from the group consisting of 0.01 to 1.5% by weight of niobium and tantalum.

23. The alloy as defined in claim 19, wherein further said alloy are included at least one selected from the group consisting of 0.001 to 0.2% by weight of boron and zirconium.

24. The alloy as defined in claim 20, wherein further said alloy are included at least one selected from the group consisting of 0.001 to 0.2% by weight of boron and zirconium.

25. The alloy as defined in claim 22, wherein further said alloy are included at least one selected from the group consisting of 0.001 to 0.2% by weight of boron and zirconium.

26. The thermal and wear resistant, tough alloy according to claim 1 consisting essentially of 0.65 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, 1 to 8% by weight of cobalt and the balance iron and incidental impurities.

27. The alloy as defined in claim 26, wherein further said alloy is included 0.005 to 0.2% by weight of nitrogen.

28. The alloy as defined in claim 26, wherein further said alloy are included at least one selected from the group consisting 0.01 to 1.5% by weight of niobium and tantalum.

29. The alloy as defined in claim. 26, wherein further said alloy are included at least one selected from the group consisting of 0.001 to 0.2% by weight of boron and zirconium.

30. The alloy as defined in claim 27, wherein further said alloy are included at least one selected from the group consisting of 0.01 to 1.5% by weight of niobium and tantalum.

31. The alloy as defined in claim 27, wherein further said alloy are included at least one selected from the group consisting of 0.001 to 0.2% by weight of boron and zirconium.

32. The alloy as defined in claim 28, wherein further said alloy are included at least one selected from the group consisting of 0.001 to 0.2% by weight of boron and zirconium.

33. The alloy as defined in claim 30, wherein further said alloy are included at least one selected from the group consisting of 0.001 to 0.2% by weight of boron and zirconium.

34. The thermal and wear resistant, tough alloy according to claim 1 consisting essentially of 0.65 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, 0.1 to 3% by weight of silicon, 1 to 8% by weight of cobalt and the balance iron and incidental impurities.

35. The alloy as defined in claim 34, wherein further said alloy is included 0.005 to 0.2% by weight of nitrogen.

36. The alloy as defined in claim 34, wherein further said alloy are included at least one selected from the group consisting of 0.01 to 1.5% by weight of niobium and tantalum.

37. The alloy as defined in claim 34, wherein further said alloy are included at least one selected from the group consisting of 0.001 to 0.2% by weight of boron and zirconium.

38. The alloy as defined in claim 35, wherein further said alloy are included at least one selected from the group consisting of 0.01 to 1.5% by weight of niobium and tantalum.

39. The alloy as defined in claim 35, wherein further said alloy are included at least one selected from the group consisting of 0.001 to 0.2% by weight of boron and zirconium.

40. The alloy as defined in claim 36, wherein further said alloy are included at least one selected from the group consisting of 0.001 to 0.2% by weight of boron and zirconium.

41. The alloy as defined in claim 38, wherein further said alloy are included at least one selected from the group consisting of 0.001 to 0.2% by weight of boron and zirconium.

42. The thermal and wear resistant, tough alloy according to claim 1 consisting essentially of 0.65 to 1.9% by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, 0.1 to 2% by weight of manganese, 1 to 8% by weight of cobalt and the balance iron and incidental impurities.

43. The alloy as defined in claim 42, wherein further said alloy is included 0.005 to 0.2% by weight of nitrogen.

44. The alloy as defined in claim 42, wherein further said alloy are included at least one selected from the group consisting of 0.01 to 1.5% by weight of niobium and tantalum.

45. The alloy as defined in claim 42, wherein further said alloy are included at least one selected from the group consisting of 0.001 to 0.2% by weight of boron and zirconium.

46. The alloy as defined in claim 43, wherein further said alloy are included at least one selected from the group consisting of 0.01 to 1.5% by weight of niobium and tantalum.

47. The alloy as defined in claim 43, wherein further said alloy are included at least one selected from the group consisting 0.001 to 0.2% by weight of boron and zirconium.

48. The alloy as defined in claim 44, wherein further said alloy are included at least one selected from the group consisting of 0.001 to 0.2% by weight of boron and zirconium.

49. The alloy as defined in claim 46, wherein further said alloy are included at least one selected from the group consisting of 0.001 to 0.2% by weight of boron and zirconium.

50. The thermal and wear resistant, tough alloy according to claim 1 consisting essentially of 0.65 to 1.9 by weight of carbon, 28 to 39% by weight of chromium, 25 to 49% by weight of nickel, 0.01 to 4.5% by weight of titanium, 0.01 to 4.5% by weight of aluminium, 0.1 to 8% by weight of tungsten, 0.1 to 9% by weight of molybdenum, 0.1 to 3% by weight of silicon, 0.1 to 2% by weight of manganese, 1 to 8% by weight of cobalt and the balance iron and incidental impurities.

51. The alloy as defined in claim 50, wherein further said alloy is included 0.005 to 0.2% by weight of nitrogen.

52. The alloy as defined in claim 50, wherein further said alloy are included at least one selected from the group consisting of 0.01 to 1.5% by weight of niobium and tantalum.

53. The alloy as defined in claim 50, wherein further said alloy are included at least one selected from the group consisting of 0.001 to 0.2% by weight of boron and zirconium.

54. The alloy as defined in claim 51, wherein further said alloy are included at least one selected from the group consisting of 0.01 to 1.5% by weight of niobium and tantalum.

55. The alloy as defined in claim 51, wherein further said alloy are included at least one selected from the group consisting of 0.001 to 0.2% by weight of boron and zirconium.

56. The alloy as defined in claim 52, wherein further said alloy are included at least one selected the group consisting of 0.001 to 0.2% by weight of boron and zirconium.

57. The alloy as defined in claim 54, wherein further said alloy are included at least one selected from the group consisting of 0.001 to 0.2% by weight of boron and zirconium.

58. The alloy as defined in claim 1 wherein the amount, when present, of silicon is 0.1 to 3%, manganese is 0.1 to 2% cobalt is 1 to 8%, nitrogen is 0.05 to 0.2% niobium and tantalum is 0.01 to 1.5%, and boron and zirconium are 0.001 to 0.2%.

* * * * *